US011008755B2

(12) United States Patent
Cook

(10) Patent No.: US 11,008,755 B2
(45) Date of Patent: May 18, 2021

(54) CEILING SYSTEM AND HANGER FOR SUSPENDING CEILING TILES OR PANELS THEREFROM

(71) Applicant: Andrew Cook, Fort Erie (CA)

(72) Inventor: Andrew Cook, Fort Erie (CA)

( * ) Notice: Subject to any disclaimer, the term of this patent is extended or adjusted under 35 U.S.C. 154(b) by 0 days.

(21) Appl. No.: 16/523,450

(22) Filed: Jul. 26, 2019

(65) Prior Publication Data

US 2020/0080305 A1 Mar. 12, 2020

Related U.S. Application Data

(60) Provisional application No. 62/729,719, filed on Sep. 11, 2018.

(51) Int. Cl.

| | |
|---|---|
| ***E04D 13/18*** | (2018.01) |
| ***E04B 9/04*** | (2006.01) |
| ***E04B 9/00*** | (2006.01) |
| ***E04B 9/18*** | (2006.01) |
| ***F21S 8/04*** | (2006.01) |
| ***F21V 5/04*** | (2006.01) |
| ***E04B 9/32*** | (2006.01) |
| *F21Y 115/10* | (2016.01) |

(52) U.S. Cl.

CPC ..... *E04B 9/04* (2013.01); *E04B 9/001* (2013.01); *E04B 9/006* (2013.01); *E04B 9/18* (2013.01); *E04B 9/32* (2013.01); *F21S 8/043* (2013.01); *F21V 5/04* (2013.01); *F21Y 2115/10* (2016.08)

(58) Field of Classification Search

None

See application file for complete search history.

(56) References Cited

U.S. PATENT DOCUMENTS

| | | | | | |
|---|---|---|---|---|---|
| 2,073,036 | A | * | 3/1937 | Voigt | E04B 9/22 52/506.1 |
| 2,923,515 | A | * | 2/1960 | Farrington | F21V 21/38 248/321 |
| 3,046,617 | A | * | 7/1962 | Grayboff | E04B 9/345 52/633 |
| 3,153,304 | A | * | 10/1964 | Evangelista | E04B 9/0464 52/144 |
| 3,390,495 | A | * | 7/1968 | Dalby | E04B 9/363 52/222 |
| 3,396,497 | A | * | 8/1968 | Murphy | E04B 9/34 52/80.1 |
| 3,418,766 | A | * | 12/1968 | Jackson | E04B 9/22 52/83 |
| 3,791,089 | A | * | 2/1974 | Alderman | E04B 9/18 52/506.06 |
| 4,189,888 | A | * | 2/1980 | Blitzer, Jr. | E04B 9/04 52/311.1 |
| 4,702,056 | A | * | 10/1987 | Carey | E04B 9/32 52/506.07 |

(Continued)

*Primary Examiner* — Basil S Katcheves

(74) *Attorney, Agent, or Firm* — Kinney & Lange, P.A.

(57) ABSTRACT

A hanger for suspending tiles or panels from a ceiling or roof, and a ceiling system incorporating the hanger, is provided. The hanger comprises a suspension member securable to the ceiling, having a longitudinal axis, and a panel mount coupled to the suspension member and releasably securable to each of a multiple panels to hold the multiple panels in a spaced relation from the ceiling on a common plane.

5 Claims, 37 Drawing Sheets

(56) References Cited

U.S. PATENT DOCUMENTS 5,251,415 A * 10/1993 Van Auken ..... E04D 13/1618 52/407.4
5,409,230 A * 4/1995 Dunaway ..... A63B 69/3676 473/160
5,772,314 A * 6/1998 Brumer ..... E04B 9/32 362/147
6,006,476 A * 12/1999 Zarnick ..... E04B 1/994 52/144
6,092,913 A * 7/2000 Edwards, Jr. ..... F21S 8/02 362/147
6,192,642 B1 * 2/2001 Colson ..... E04B 9/00 52/506.01
8,702,264 B1 * 4/2014 Rashidi ..... F21S 8/026 362/147
9,182,091 B2 * 11/2015 Gershaw ..... F21S 8/04
9,273,465 B1 * 3/2016 Bergman ..... E04B 9/18
2003/0046890 A1 * 3/2003 Lynch ..... B44C 5/04 52/506.07
2006/0174562 A1 * 8/2006 Insalaco ..... E04B 9/06 52/220.6
2009/0237958 A1 * 9/2009 Kim ..... G02B 6/0031 362/617
2010/0201610 A1 * 8/2010 Lo ..... G06F 3/1446 345/82
2010/0236154 A1 * 9/2010 Bear ..... H05B 45/00 52/28
2011/0103043 A1 * 5/2011 Ago ..... F21S 8/04 362/147
2013/0294079 A1 * 11/2013 Tran ..... F21S 8/046 362/249.15
2016/0037765 A1 * 2/2016 Peters ..... A01K 3/005 52/101
2017/0044767 A1 * 2/2017 Gloftis ..... E04B 9/18
2017/0089064 A1 * 3/2017 Frantz ..... B32B 3/02
2019/0112809 A1 * 4/2019 Frantz ..... F24F 5/0021

* cited by examiner

CEILING SYSTEM AND HANGER FOR SUSPENDING CEILING TILES OR PANELS THEREFROM

FIELD

This disclosure relates generally to a suspended ceiling system and a hangar for suspending ceiling tiles or panels in the suspended ceiling system.

BACKGROUND

Suspended ceiling systems typically employ T-bars or rails to hold ceiling panels or tiles in place adjacent to the ceiling. Commonly, the ceiling tiles in a suspended ceiling rest with their edges in contact with a lateral flange or a T-bar rail such that all four sides of a typical rectangular tile are framed by the T-bar. Where a ceiling tile has a side that is adjacent to a wall, an L-bracket fixed to the wall surface, replaces the T-bar along the wall side of the tile. The net result is a rectangular grid of T-bars and L-brackets, with individual ceiling tiles placed and suspended within the individual rectangular openings in the grid.

As is also typically the case with suspended ceiling systems, lighting devices, sprinklers and other fixtures are often integrated into the ceiling tiles or below the ceiling tiles so the light, water, or air flow etc. from the fixture has access to the room below. In this manner, however, the fixture is commonly visible to an individual in the room.

SUMMARY

The present disclosure, therefore, provides a ceiling system for a room, the ceiling system comprising: a plurality of rib members arranged in a grid, one or more hangers secured to and suspended from the grid, and one or more panels suspended by the one or more hangers and spaced apart from the plurality of rib members on a common plane.

In another aspect there is provided a hanger for suspending tiles or panels from a ceiling, the hanger comprising: a suspension member securable to the ceiling, having a longitudinal axis, and a panel mount coupled to the suspension member and releasably securable to each of a multiple panels to hold the multiple panels in a spaced relation from the ceiling on a common plane with their adjacent edges abutting.

In another aspect there is provided a ceiling system comprising: a plurality of rails and cross members arranged in a grid, each of the plurality of rails having a light assembly; one or more hangers secured to and suspended from the grid; and one or more mesh panels suspended by the one or more hangers and spaced apart from the plurality of rib members on a common plane, each of the mesh panels having a plurality of apertures for diffusing light from the light assemblies.

Further aspects of the disclosure will become apparent from the following description taken together with the accompanying drawings.

BRIEF DESCRIPTION OF THE DRAWINGS

For a better understanding of the present disclosure, and to show more clearly how it may be carried into effect, reference will now be made, by way of examples, to the accompanying drawings which show exemplary embodiments of the present disclosure in which.

DETAILED DESCRIPTION

The present disclosure may be embodied in a number of different forms. The specification and drawings that follow describe and disclose some of the specific forms of the disclosure.

Referring to the attached drawings, FIGS. 1 to 5 show an exemplary embodiment of a hanger 10 for suspending multiple ceiling tiles or panels (not shown) from a ceiling (not shown) according to an embodiment of the present disclosure.

Figure 5:
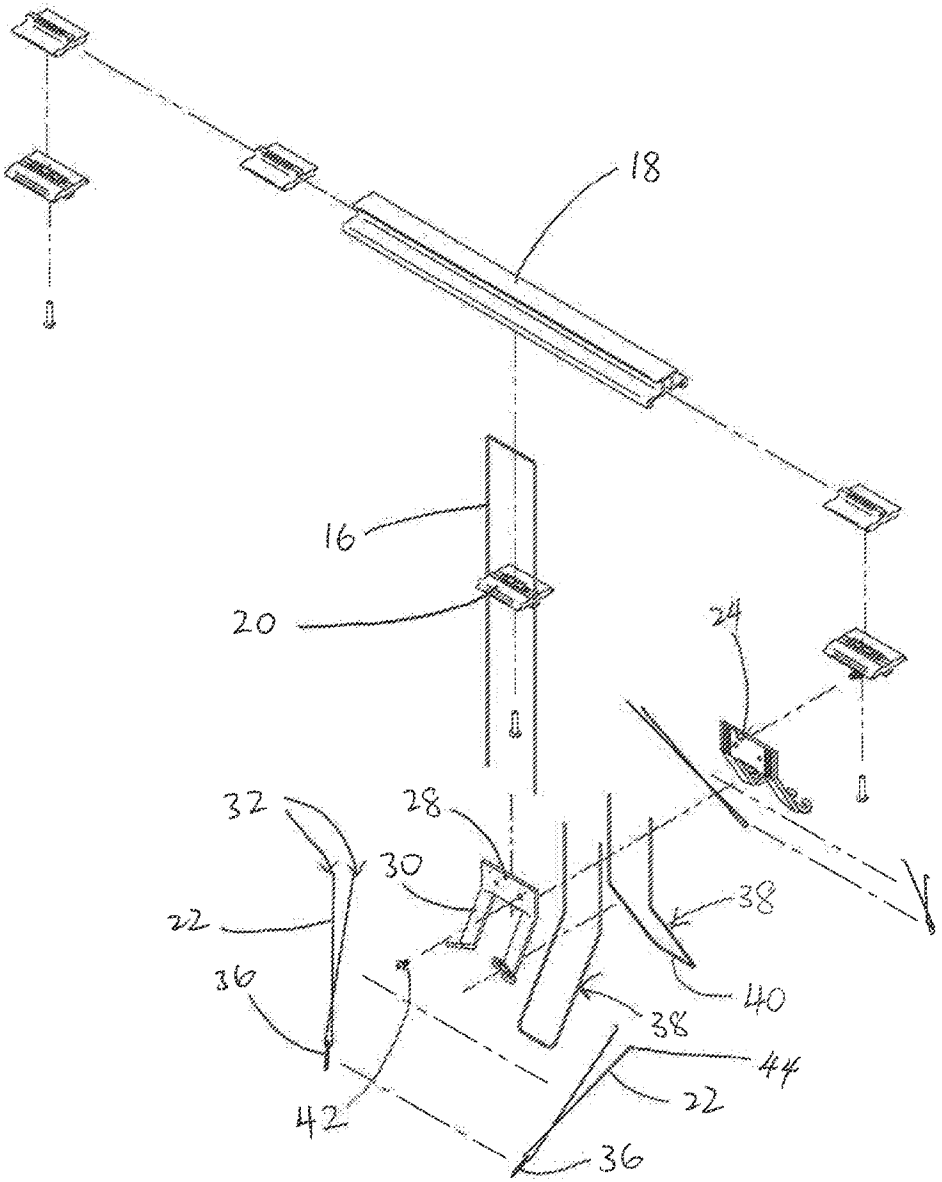
FIG. 5 is an exploded view of the hanger of FIG. 1.

Hanger 10 includes a suspension member 12 and a tile or panel mount 14. Suspension member 12 has a longitudinal axis and is securable to a ceiling. In the depicted embodiment, suspension member 12 is a wire frame 16. Alternatively, it may be a threaded rod or any one of a variety of other suspension structures. As shown in FIG. 5, wire frame 16 may be secured to a grid mount 18 by a clamp 20. Grid mount 18 may be coupled to a grid, which in turn may be secured to the ceiling (see below). Alternatively, grid mount 18 may be secured directly to the ceiling. In yet a further embodiment, suspension member 12 may be secured directly to the ceiling or roof structure.

Panel mount 14 includes multiple torsion springs 22 releasably secured to a pair of elevation brackets 24. Each of the torsion springs 22 are coupled to, and extend away from, wire frame 16 via their attachment to one of the elevation brackets 24.

Each elevation bracket 24 includes a bracket body 28 and a pair of arms 30 extending away from bracket body 28. Each torsion spring 22 has a pair of upper ends 32 bent or otherwise configured for hooking onto or attaching to one of arms 30 of elevation bracket 24.

The bracket bodies of two elevation brackets 24 may be joined together about wire frame 16 and secured with screws or other fasteners 42. In this manner, elevation brackets 24 can be slid along wire frame 16 before screws 42 are tightened to permit the elevation of the torsion springs, relative to the roof or ceiling, to be adjusted. It will be understood that, rather than two separate components, the elevation bracket may instead be a single unit having a bracket body 28 and four arms 30 extending outwardly therefrom.

In the presented embodiment, arms 30 extend away from bracket bodies 28 and form spring engagement means, which in this embodiment are hooks 34 at their distal ends. Hooks 34, in turn, releasably couple upper ends 32 (having overturned or bent tips 44) of torsion springs 22 to arms 30. It will be appreciated that in this particular embodiment, the crossing of the two legged torsion springs 22 forces upper ends 32 away from one another to assist in maintaining upper ends 32 in engagement with hooks 34. In order to disengage a torsion spring from its corresponding hook 34, upper ends 32 are squeezed together, to release their bent tips 44 from hooks 34.

Figure 2:
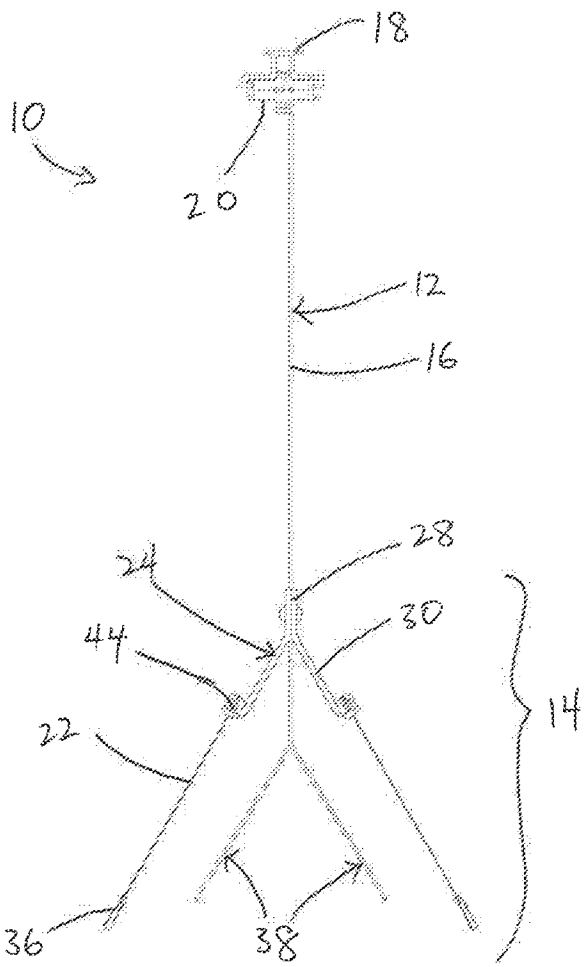
FIG. 2 is a side view of the hanger of FIG. 1.
Figure 1:
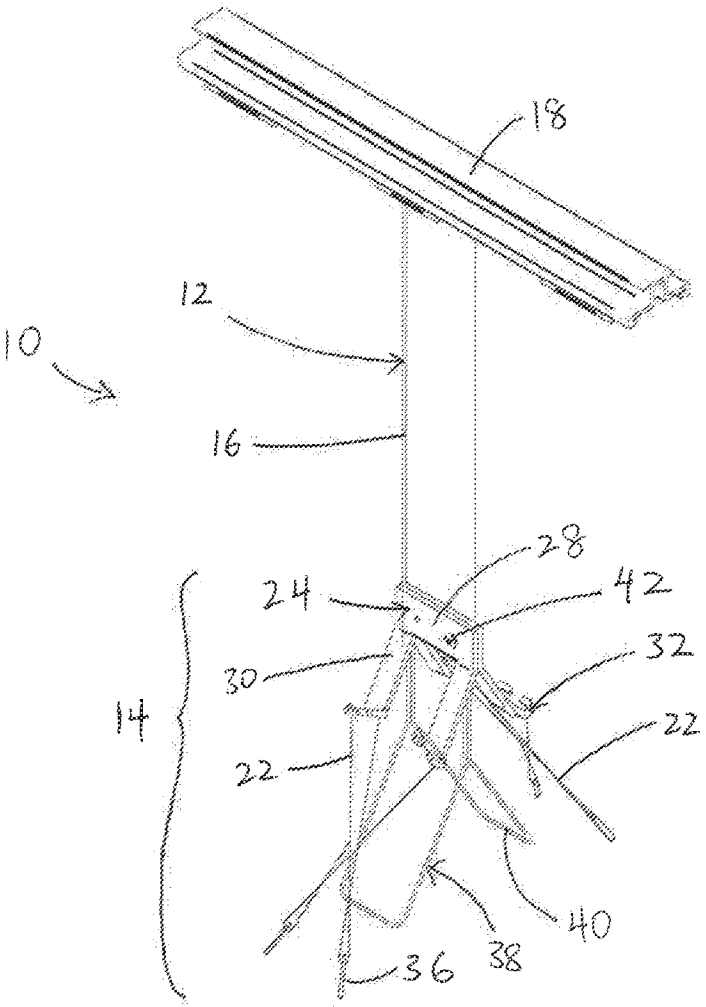
FIG. 1 is an upper perspective view of an exemplary hanger according to an embodiment of the present disclosure.
Figure 4:
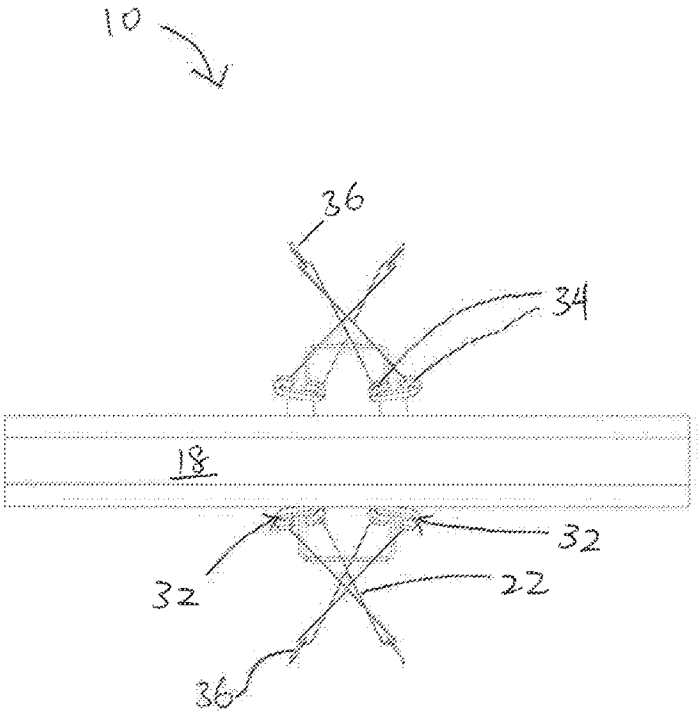
FIG. 4 is a plan view of the hanger of FIG. 1.
Figure 3:
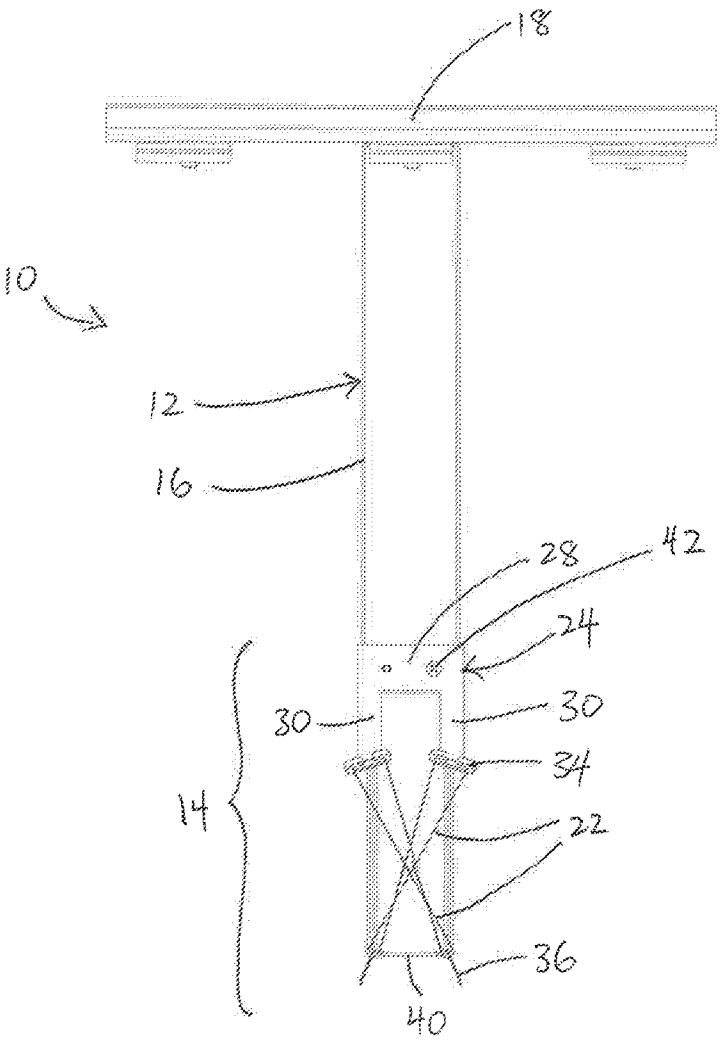
FIG. 3 is a front view of the hanger of FIG. 1.
Figure 6:
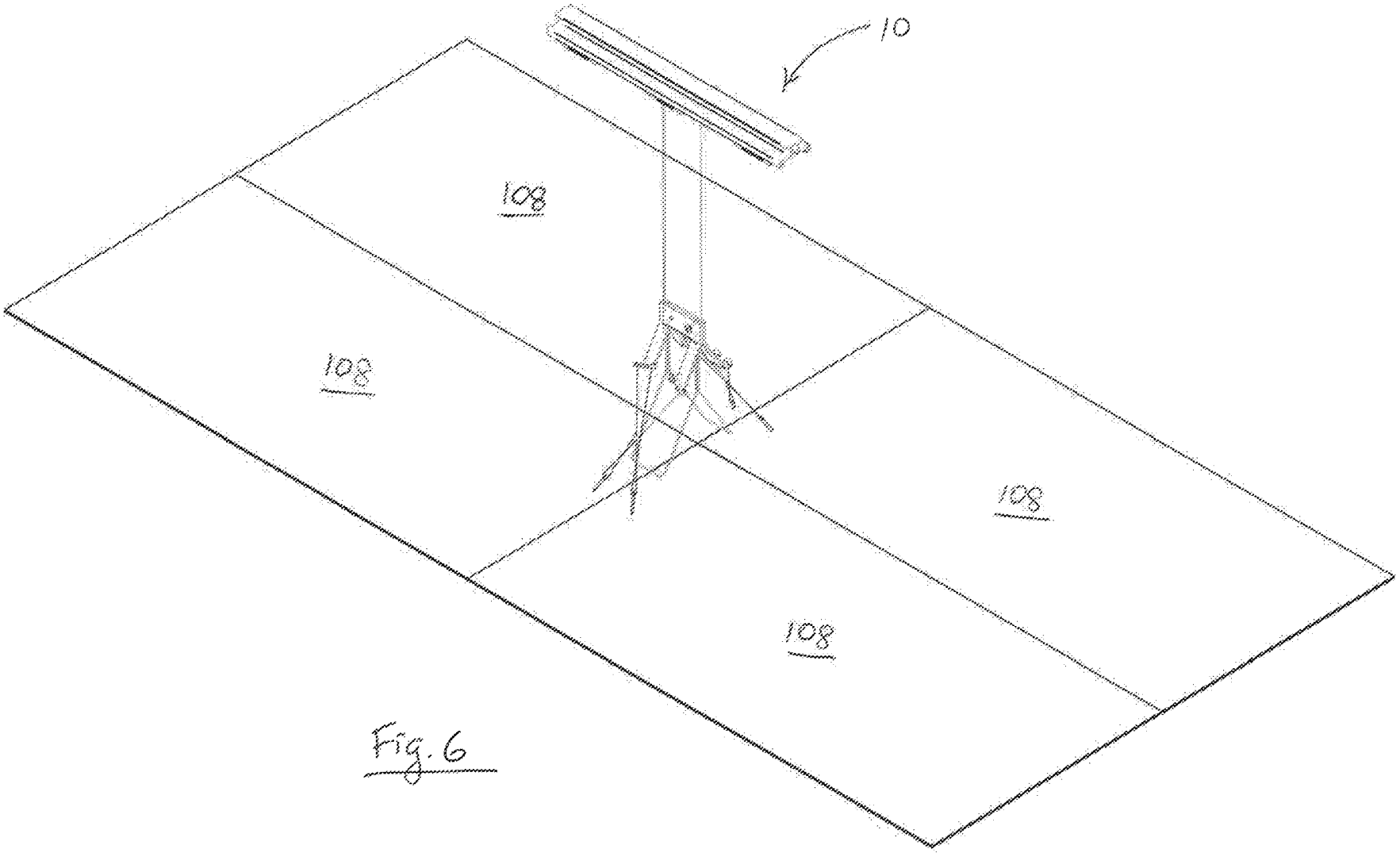
FIG. 6 is an upper perspective view of the hanger of FIG. 1 in use with tiles or panels.

As best seen in the embodiment of FIGS. 1, 3, and 4, a pair of torsion springs 22 is secured in a crossed or an X-formation on each bracket body 28. When releasably coupled to two adjacent ceiling tiles, the torsion springs in the X configuration pull the two tiles in laterally opposite directions, thus bringing the edges of the tiles into an abutting relationship. In the depicted embodiment, panel mount 14 comprises four torsion springs 22 that are to be coupled to four ceiling tiles. As shown in FIG. 6, two pairs of torsion springs 22 are arranged in a back-to-back X-formation, such that a corner of each of the four tiles is held abutting together.

Alternatively, the two pairs of torsion springs may be coupled to one tile each, such that when the two pairs of torsion springs 22 are arranged in a back-to-back X-formation, two tiles may be held in an abutting relationship.

While an X-formation is shown, torsion springs 22 may alternatively be arranged in other manners so as to bring the edges of at least two tiles or panels together. For example, torsion springs 22 may instead be in a V-formation.

Panel mount 14 further comprises clips 36 secured to a lower end of each torsion spring 22 for securing to a ceiling tile. Where the tiles are mesh, the tiles may have screw eyes or other such features incorporated in them. Clips 36 may be a snap clip, a carabiner, a simple hook or another form of fastener that can be releasably secured to a feature on the tile or to the tile itself. Springs 22 may also be attached to the ceiling tiles by other means.

While panel mount 14, in the present embodiment, includes multiple torsion springs 22, other means could be used to couple the panel to elevation bracket 24, including a coil spring or a simple wire structure.

The arrangement of clips 36, torsion springs 22 and elevation brackets 24 collectively hold the ceiling tiles in place. In order to maintain the panels in a desired spaced relation from the ceiling on a common plane, hanger 10 further comprises a panel stop 38 extending from suspension member 12 for abutment with the upper surface of the panels or tiles. In the depicted embodiment, hanger 10 includes a pair of panel stops 38. Each panel stop 38 has an abutment portion which directly abuts (most commonly) a pair of tiles. In the depicted embodiment, hanger 10 has two panel stops 38 positioned back-to-back, angled away from the longitudinal axis of wire frame 16, forming a general V-configuration. In an embodiment, each panel stop 38 is a rigid wire structure having a horizontal portion 40 which abuts the upper surface of (typically) a pair of ceiling tiles during operation, as best seen in FIG. 6.

In use, springs 22 tend to "pull" the multiple ceiling tiles up towards the ceiling and towards each other such that their edges abut, while panel stops 38 limit upward movement of the tiles at a specified distance. In this manner, springs 22 and stops 38 collectively maintain multiple tiles or panels in spaced relation on a common plane in a desired arrangement/placement. Further, the height of the tiles can be adjusted by loosening screws 42 and altering the position of brackets 24 along wire frame 16.

To detach the tiles from hanger 10, the tiles may be pushed upwards, i.e. towards the ceiling, allowing a user to grasp torsion springs 22, displacing their tips 44, thus permitting torsion springs 22 to be removed from hooks 34.

Turning now to FIGS. 7-25, an exemplary embodiment is shown of a ceiling system 100 using, for example, hangers 10 as described above.

The depicted ceiling system 100 includes a plurality of rails 102 and cross members 102*a* arranged in a generally rectangular grid 104 (see FIGS. 11-15). The spacing of cross members 102*a* can vary depending upon the particular application and depending on the required spacing of appliances or other services (eg. lighting, sprinkler heads, speaker systems, etc) that may be mounted to or suspended from the cross members. Rails 102 and cross members 102*a* may be aluminum or polymer extrusions which are hollow to allow wiring or other components to be fed therethrough.

Figure 13:
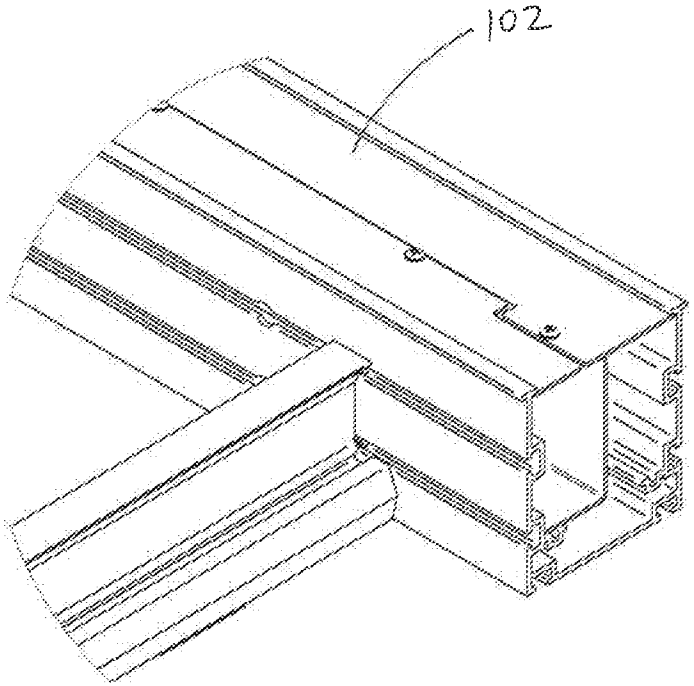
FIG. 13 is an enlarged view of portion "A" of FIG. 12.
Figure 12:
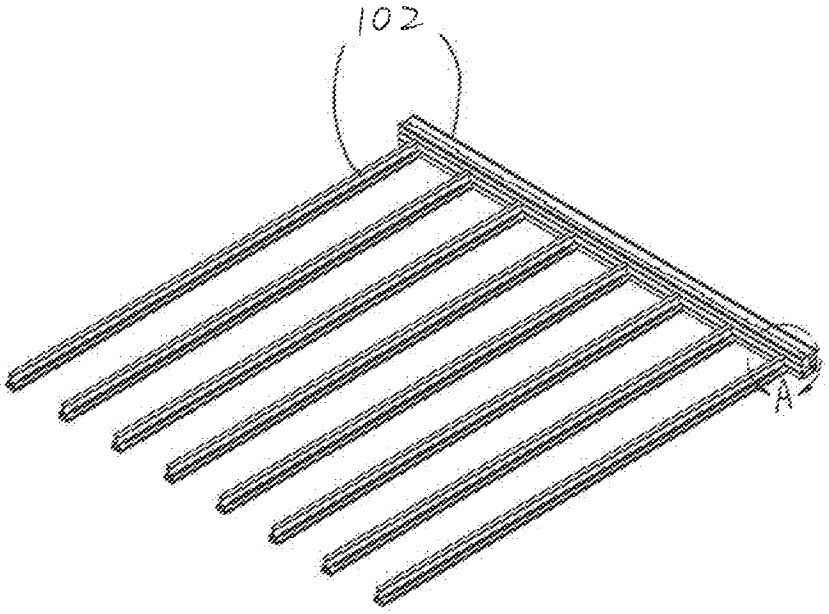
FIG. 12 is a partially assembled view of the rails and cross members of FIG. 11.
Figure 14:
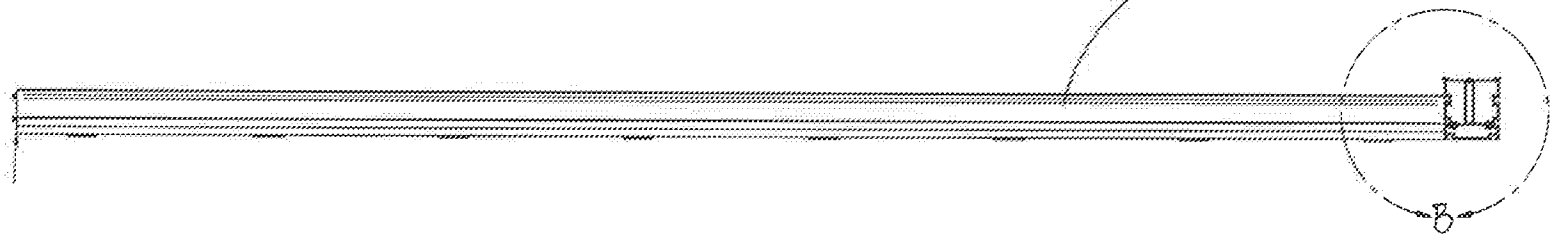
FIG. 14 is a side view of FIG. 12.
Figure 15:
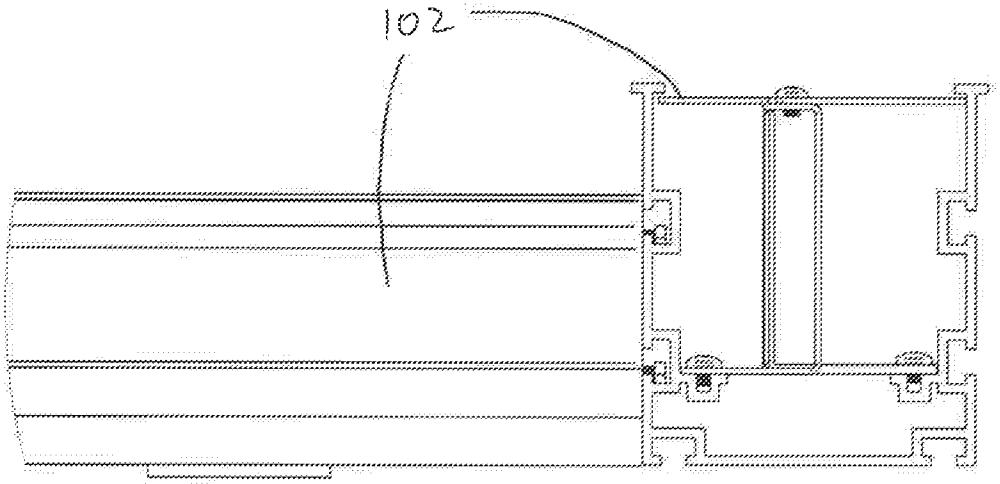
FIG. 15 is an enlarged view of portion "B" of FIG. 14.
Figure 17:
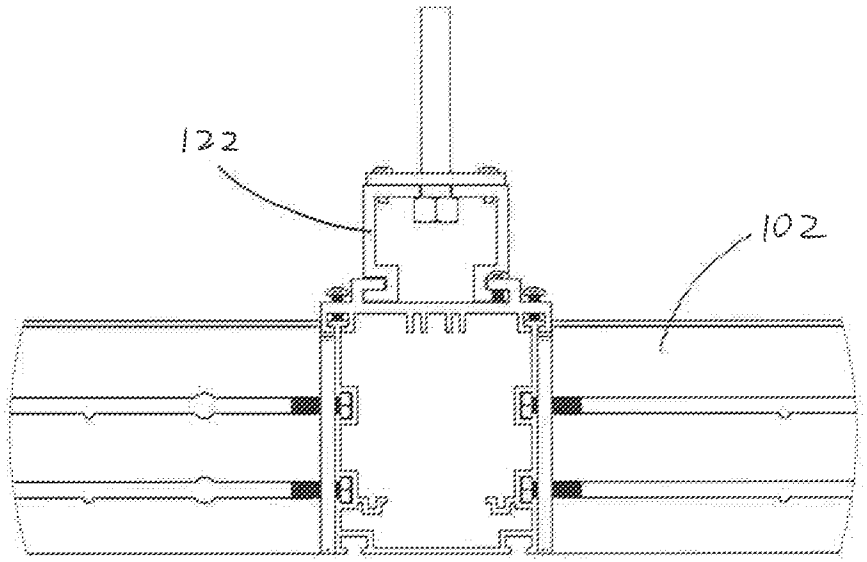
FIG. 17 is an enlarged view of portion "D" of FIG. 16.
Figure 16:
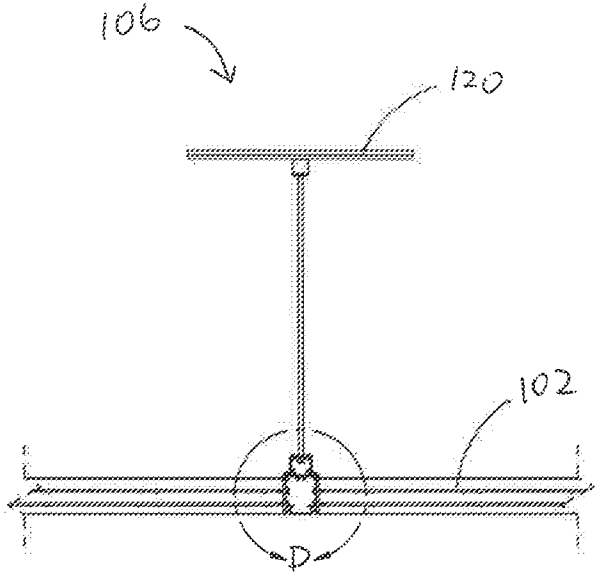
FIG. 16 is an enlarged view of portion "C" of FIG. 10, showing a rail of the ceiling grid in cross section.
Figure 19:
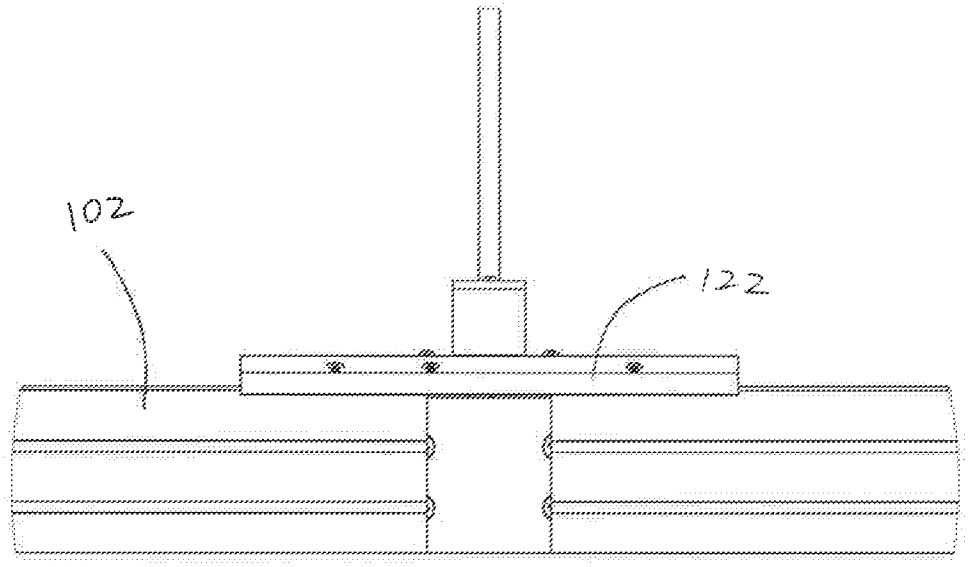
FIG. 19 is an enlarged view of portion "E" of FIG. 18.
Figure 18:
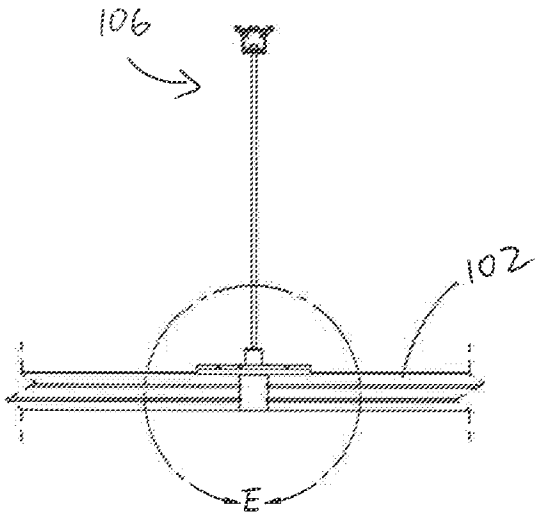
FIG. 18 is a side view of FIG. 16.
Figure 21:
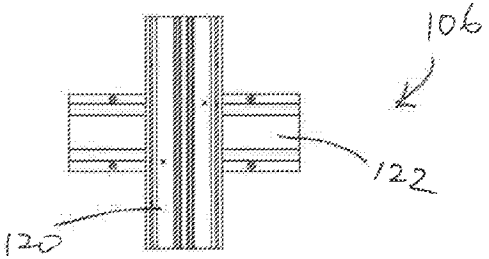
FIG. 21 is a plan view of the ceiling mount of FIG. 20.
Figure 23:
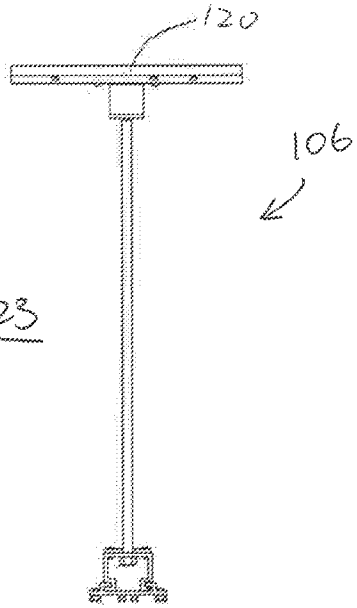
FIG. 23 is a side view of the ceiling mount of FIG. 20.
Figure 20:
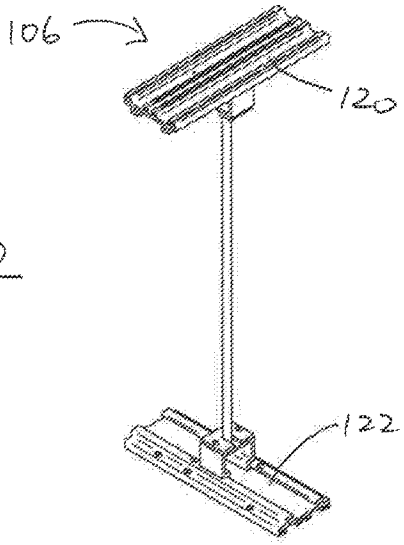
FIG. 20 is an upper perspective view of a ceiling mount of FIG. 7 in isolation.
Figure 22:
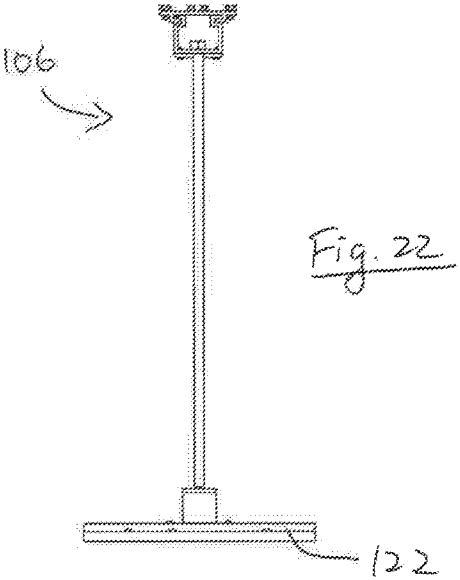
FIG. 22 is a front view of the ceiling mount of FIG. 20.
Figure 24:
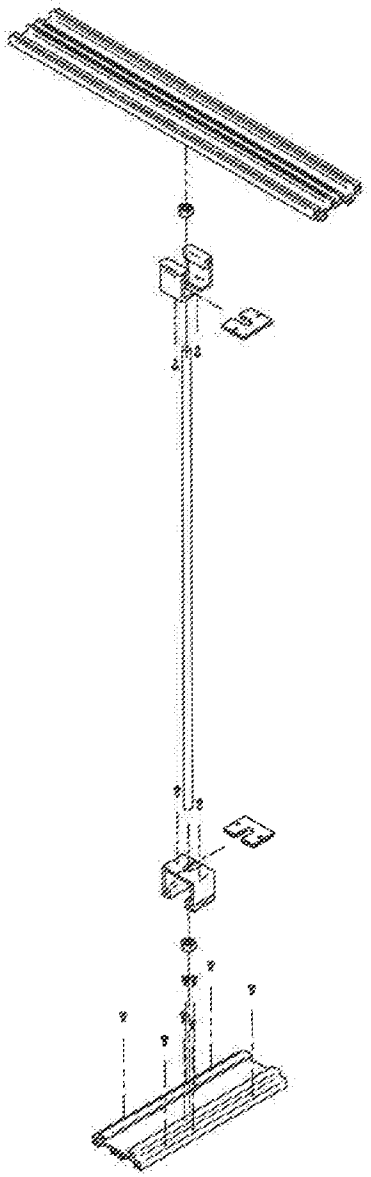
FIG. 24 is an exploded view of the ceiling mount of FIG. 20.
Figure 25:
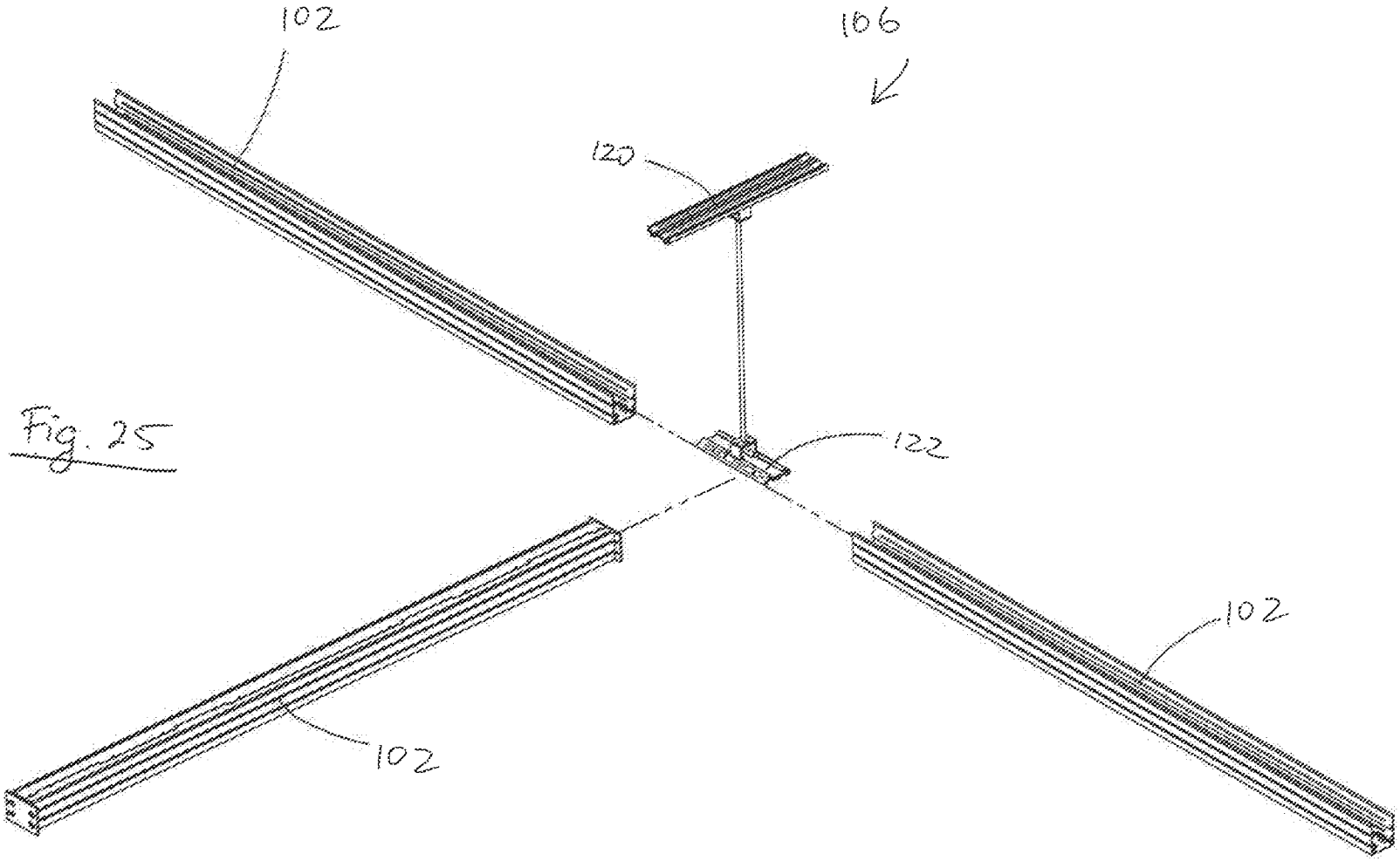
FIG. 25 is a partial exploded view of the ceiling mount of FIG. 20 with the rails and cross members of FIG. 11.

As shown in FIGS. 13, 15, and 17, the walls of rails 102 may have tracks or channels 126. The ends of cross members 102*a* may be configured to receive a fastener 42, such as a bolt or screw such that the head of the bolt or screw extends from the end of cross member 102*a*. In this manner, the head of fastener 42 may longitudinally slide along, or be engaged within, channels 126 of rail 102. When cross member 102*a* is in the desired configuration with rail 102, an additional fastener 42*a* may be inserted into rail 102 to secure cross member 102*a* in place. In this manner, rails 102 and cross members 102*a* may fit together to form modular sections of grid 104. Grid 104 is modular in structure and may be mounted to the ceiling of a room in a variety of different manners. The present embodiment shows grid 104 being suspended from a ceiling using multiple ceiling mounts 106. The depicted ceiling mounts include an upper plate 120, for securing to the ceiling structure, and a lower plate 122 to (typically) secure to a rail 102 (see FIGS. 16-25) with a support rod 124 therebetween. Upper and lower plates 120 and 122 may be of the same structure. While in many instances it is expected that lower plate 122 will be secured to a rail 102, in some instances lower plate 122 may be secured to a cross member 102*a*. Lower plate 122 may also include one or more channels which are configured to engage with ribs of rails 102 or cross members 102*a* to permit lower plate 122 to be slid along a cross member for easy installation and adjustment of ceiling mounts 106.

In the depicted embodiment, U-shaped brackets 128 connect rods 124 to upper plates 120 and lower plates 122. U-shaped brackets 128 may be fitted with overturned lips or hook members 150 to engage with correspondingly configured lip members 151 on upper plate 120 and lower plate 122. The engagement of hook members 150 with lip members 151 will thus effectively "hang" rod 124 (and hence grid 104) from upper plate 120. The engagement f hook members 150 with lip members 151 will also permit rod 124 to be slid along upper plate 120 and/or lower plate 122 as may be necessary or desirable during installation or removal. If desired, a backing plate 152 may be positioned between the end of rod 124 and U-shaped bracket 128 to assist in the connection of the rod to the bracket. Further, in some instances multiple backing plates may be inserted for ceiling leveling purposes.

Alternatively, ceiling mounts 106 may be structured to interlock with ribs 102 or cross members 102*a* in other manners.

Figure 7:
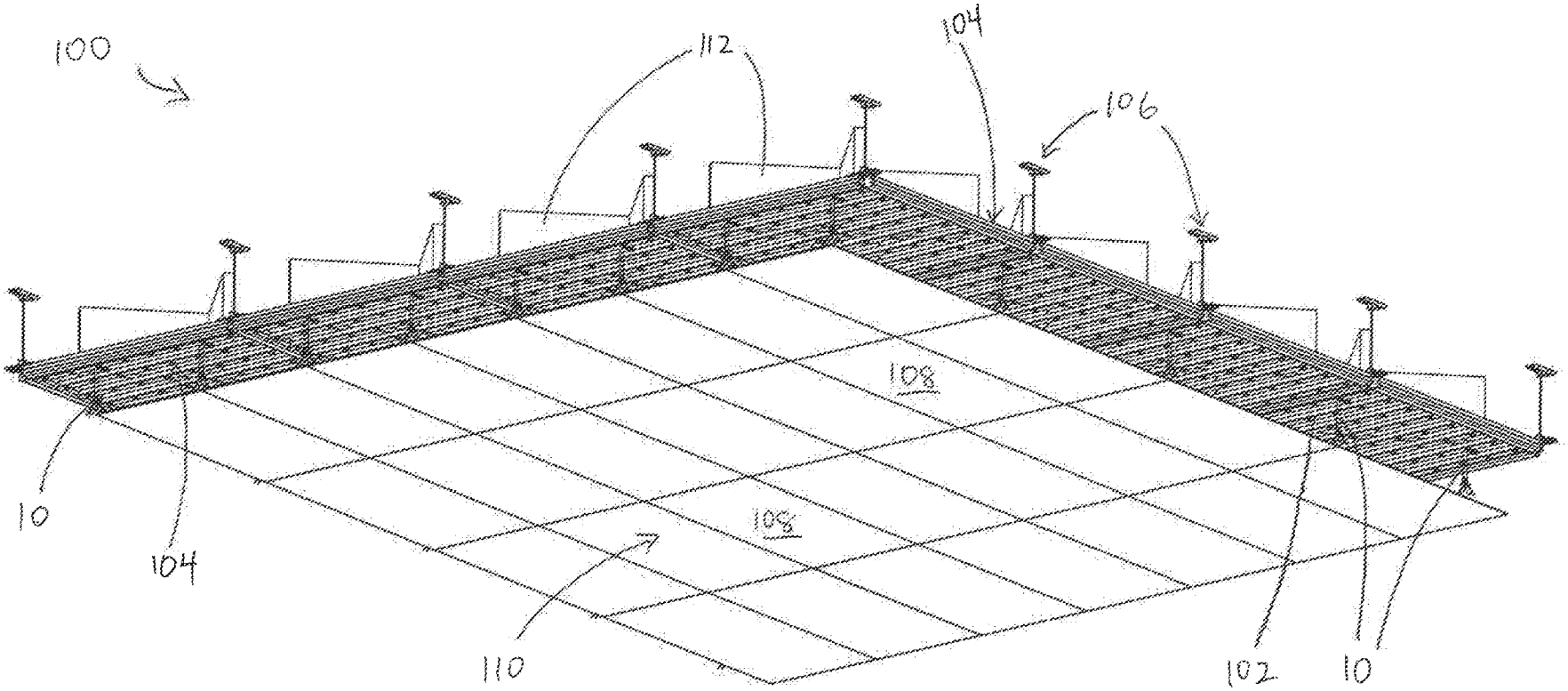
FIG. 7 is a lower perspective view of a ceiling system according to an embodiment of the present disclosure.
Figure 8:
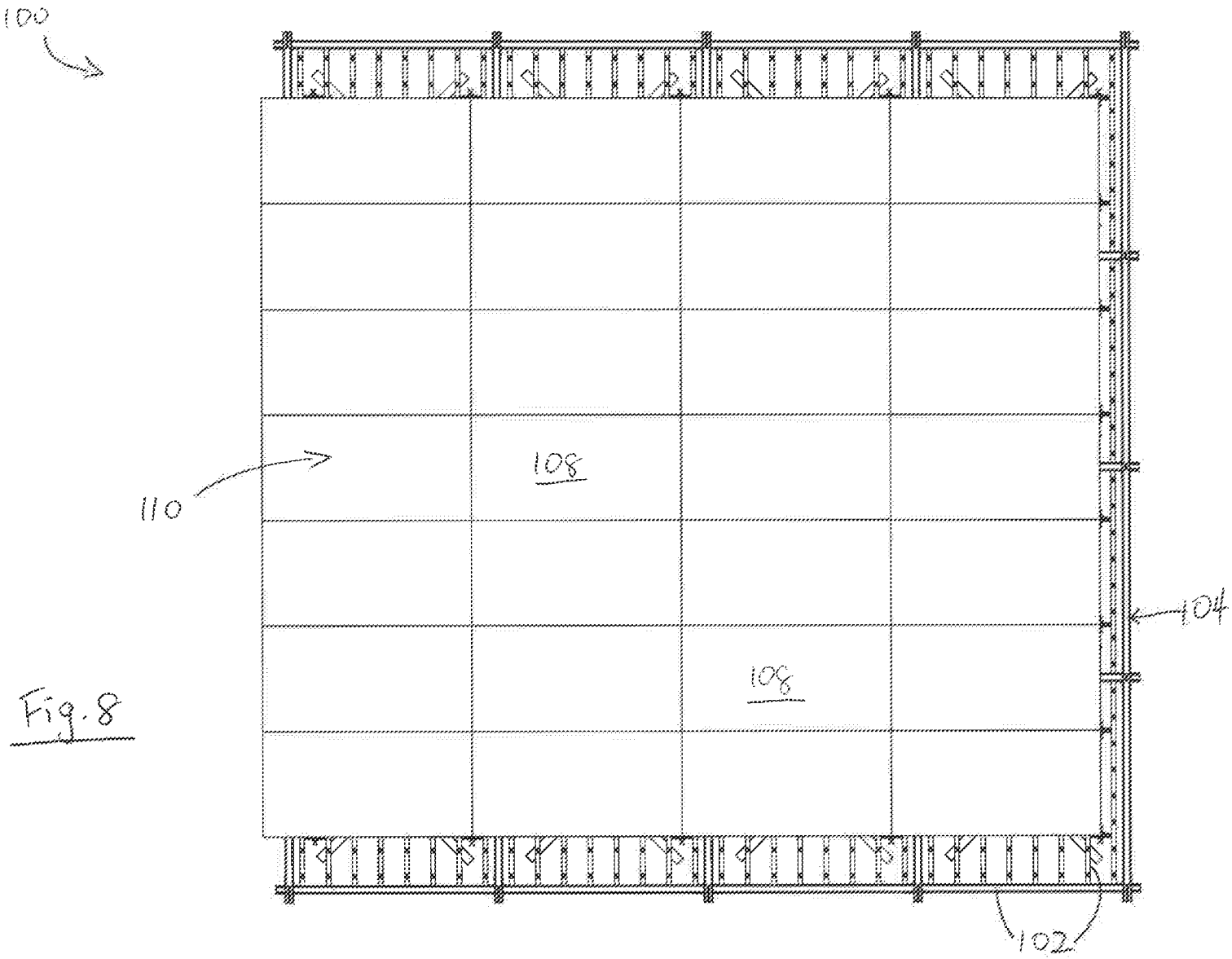
FIG. 8 is a bottom view of the ceiling system of FIG. 7.
Figure 9:
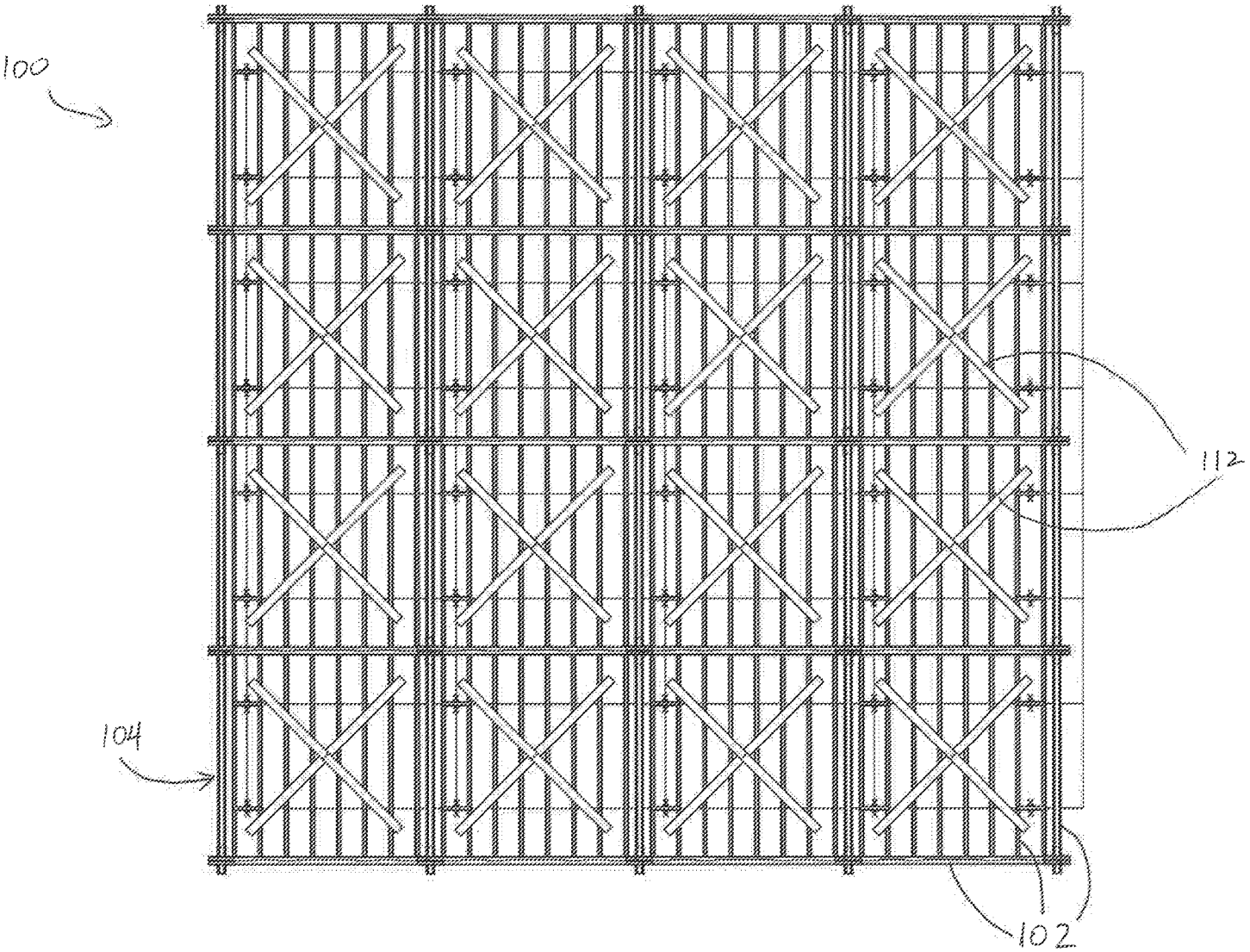
FIG. 9 is a plan view of the ceiling system of FIG. 7.
Figure 10:
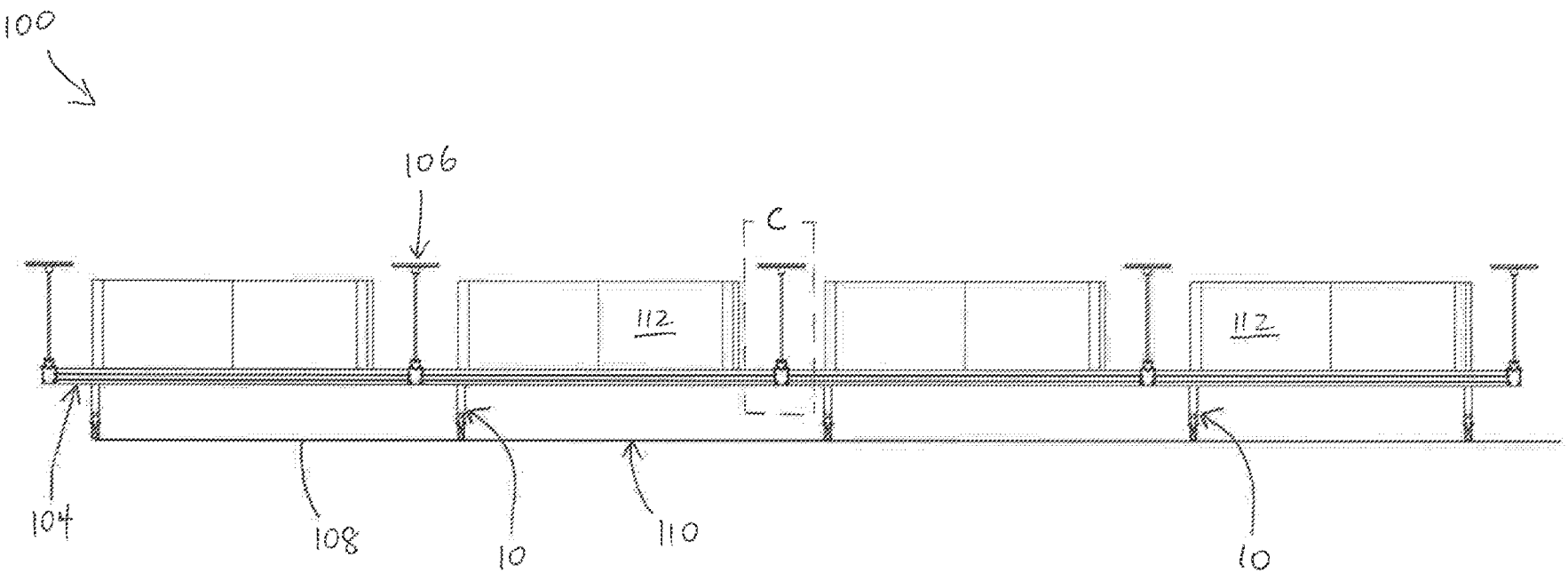
FIG. 10 is a side elevation view of the ceiling system of FIG. 7.
Figure 11:
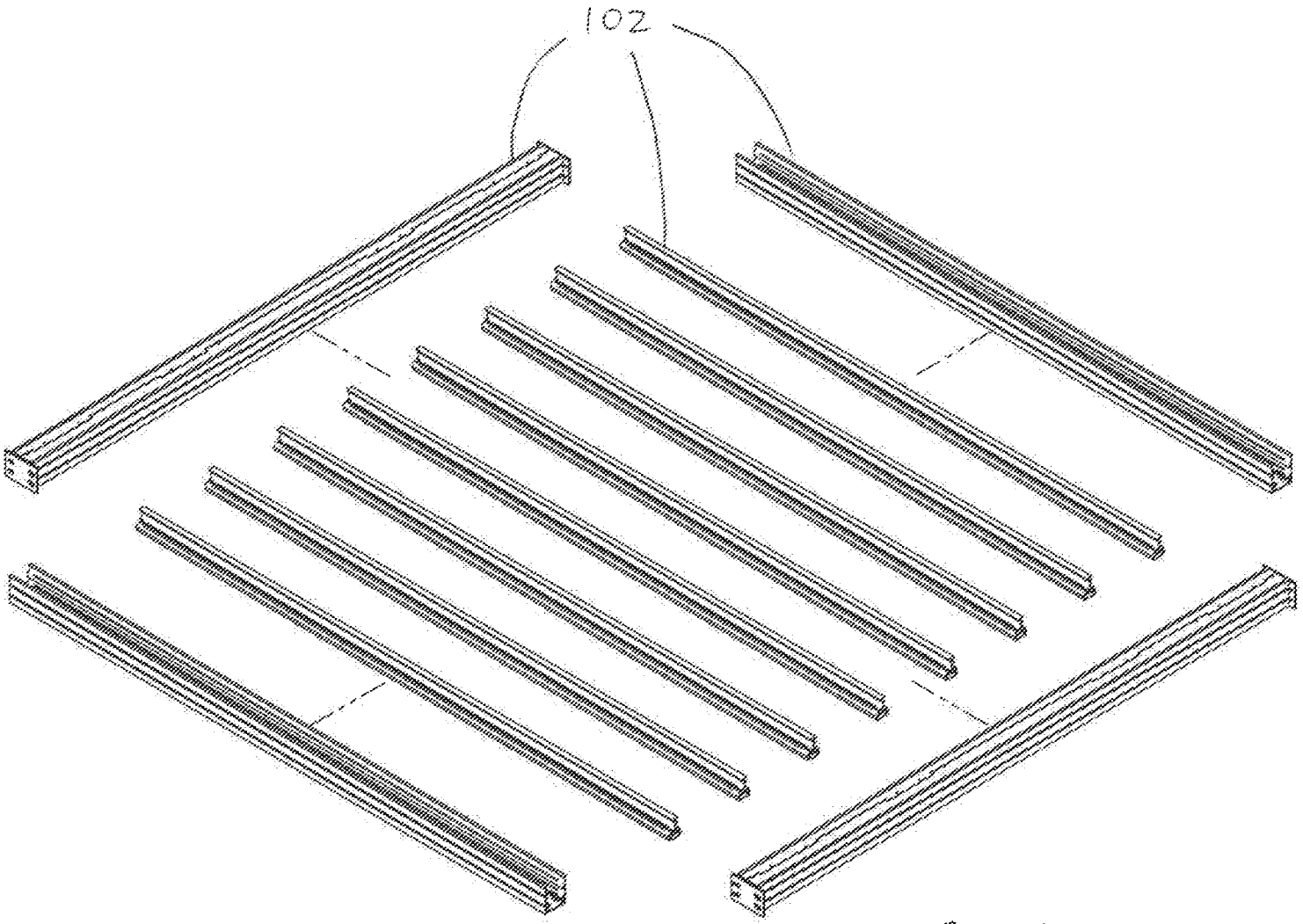
FIG. 11 is a partial exploded view of the rails and cross members of the ceiling system of FIG. 7.

As shown in FIG. 7, multiple hangers 10 may be secured to and suspended from rails 102 and/or cross members 102*a* of grid 104. In turn, hangers 10 can be used to suspend multiple ceiling tiles or panels 108, spaced apart from the grid 104 and in a common plane.

Multiple tiles or panels 108 may extend the length and width of the room in which ceiling system 100 is situated, thereby forming a seamless ceiling 110 devoid of the rectangular grid formed by a traditional T-bar ceiling. Of course, ceiling system 100 may be used to cover only part of the roof or ceiling in a room.

When panels 108 are translucent, transparent, or have defined openings therethrough, ceiling system 100 may include one or more lighting fixtures secured to rails 102 and/or cross members 102*a*. Light from the lighting fixtures may be directed or diffused through panels 108. The lighting fixtures may be spaced apart from one another such that the light is evenly diffused, providing a "glowing" effect from panels 108, which may appear as a pane of light. In certain applications, emergency or exit lighting may be secured to panels 108 or grid 104.

One or more of panels 108 may also be of a mesh or grid structure. Ceiling system 100 may then include a fire safety system including one or more sprinklers (not shown) secured to rails 102 and/or cross members 102*a*. The sprinklers may be spaced apart from one another to permit even and complete coverage of the room. The holes or openings of the mesh panel allow for water to pass or fall through the panel and into the room below. It will be understood that the above-described mesh panels may be transparent, translucent or opaque.

In certain jurisdictions, with panels which are 48"×48" or larger, it is typically required that sprinkler heads be mounted below such panels. With the open mesh panel ceiling system described above, sprinklers may be installed above the ceiling line and, thus, panels larger than 48"×48" may be used without sprinklers being mounted below the panels.

Ceiling system 100 may also include acoustic panels 112 supported by grid 104. Acoustic panels 112 are designed to reduce sound transmission through ceiling system 100. When positioned between grid 104 and the ceiling of the room, acoustic panels 112 may dampen ambient noise. In the depicted embodiment, acoustic panels 112 are arranged in a cross configuration and formed from a sound deadening or dampening material, and supported on the top of grid 104.

Other systems that may be secured to grid 104 include alarm systems, speaker systems, and HVAC systems. Given the hollow nature of rails 102 and cross members 102*a*, the wiring and physical connections which support lighting systems, alarm systems, speaker systems, and/or HVAC systems etc., may be integrated into grid 104. In this manner, rails 102 may be used as a high or low voltage wiring channel to provide power to appliances either within the ceiling or below via vertical supports. Optionally, rails 102 and cross members 102*a* of grid 104 may themselves be electrified with internal or external fixed wiring and termination connections to permit high or low voltage electricity (or other signals in general) to be transmitted in a fixed manner along the grid. The connection between a rail 102 and a cross member 102*a* may involve the connection of a respective electrical termination on the rail to a corresponding electrical termination on a corresponding cross member, presenting a plug-and-play modular structure that can be readily customized for a particular application. Rails 102 and/or cross members 102*a* may also be directly fitted with LED or other lighting sources to present a lighting source for a room without the need to physically mount and wire individual lighting fixtures, aside from the construction of grid 104. In still alternate embodiments, grid 104 may be utilized to hang or mount monitors or television screens for display or informational purposes. In still further embodiments, monitors or screens may be integrated directly within grid 104 or be hung generally horizontally below grid 104 for display or informational purposes, or to present an aesthetically appealing image on the surface of the ceiling.

While hangers 10 are described in ceiling system 100, alternative hangers, which are securable to the ceiling and which are releasably securable to multiple panels in a common plane, may be used instead.

FIGS. 26-51 illustrate another exemplary embodiment of a ceiling system 200.

Ceiling system 200 includes a plurality of alternate embodiments of the rails (noted generally by reference numeral 201), and alternate embodiments of the cross members (referred to as hollow cross members 201*a* or solid cross members 201*b*) arranged in a generally rectangular grid 104 (see FIG. 27) in a similar manner to that described above. The spacing of rails 201 and cross members 201*a*, 201*b* can vary depending upon the particular application and depending on the required spacing for appliances or other services (eg. lighting, sprinkler heads, speaker systems, etc) that may be mounted to or suspended from system 200. Rails 201 and cross members 201*a*, 201*b* may be aluminum, polymer extrusions, or formed from one or more other materials, and may be hollow to allow wiring or other components to be fed therethrough.

In the depicted embodiment, each of the plurality of rails 201 in ceiling system 200 includes a lighting assembly 212.

As shown in FIGS. 31B, 36A-36D and 37, each light assembly 212 includes light emitting diode (LED) lights running longitudinally along each corresponding rail 201. In the embodiment depicted, the LED lights are positioned on an LED strip 214.

Figure 31A:
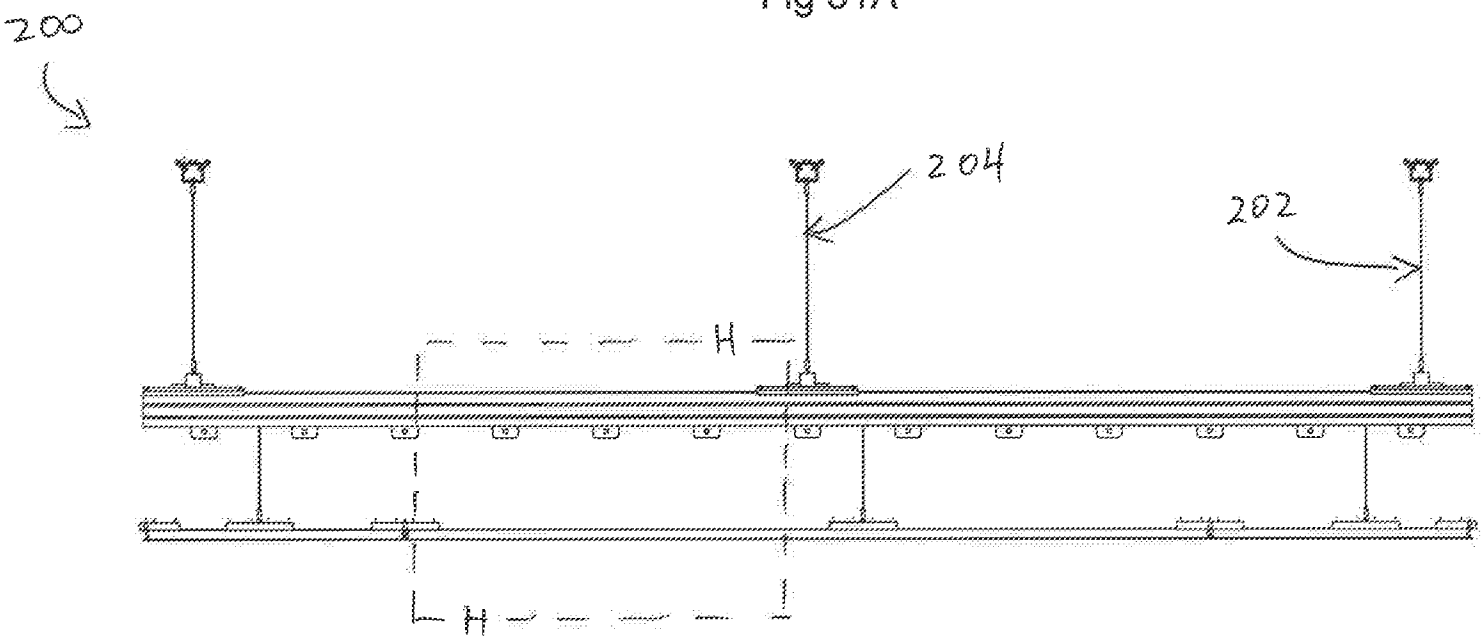
FIG. 31A is a side view of the ceiling system of FIG. 26.
Figure 31B:
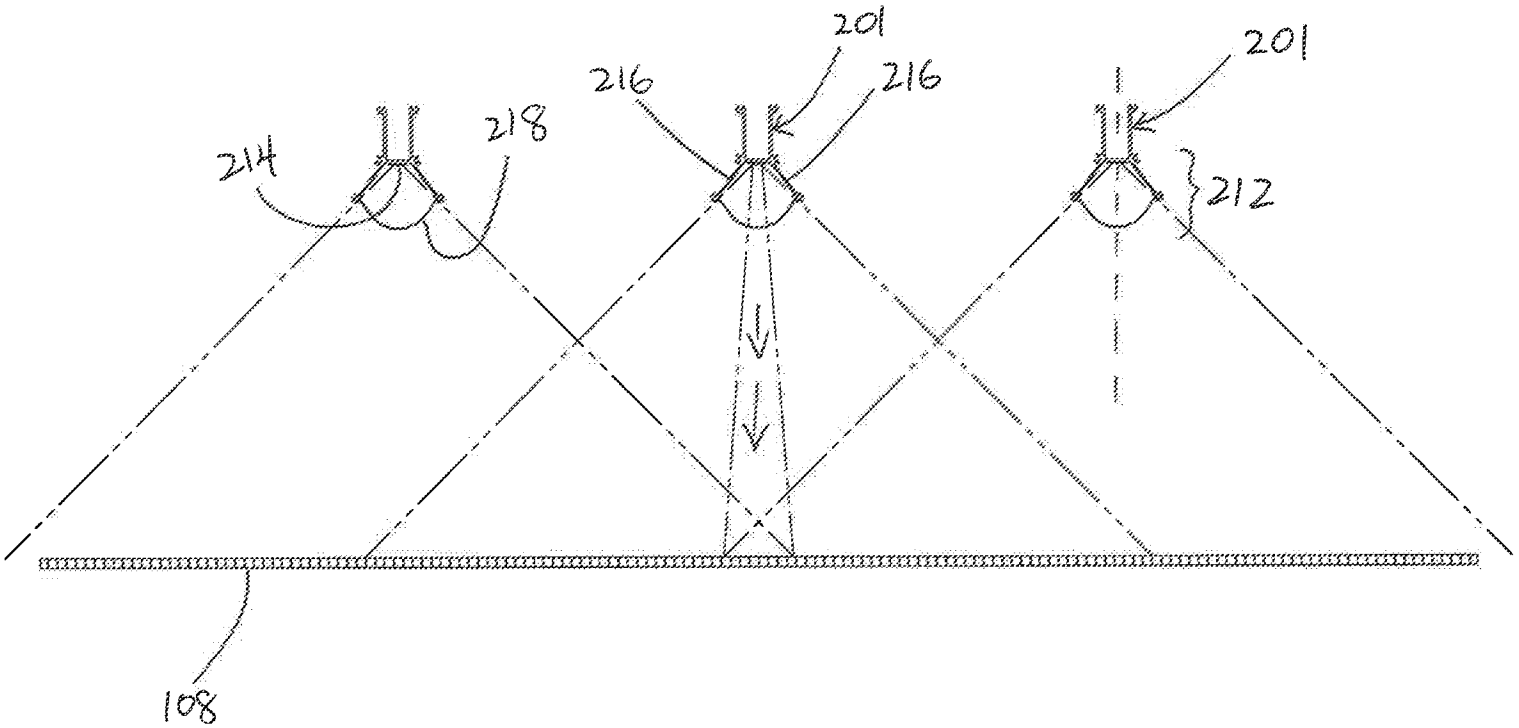
FIG. 31B is an enlarged view of portion "H" of FIG. 31A in use.
Figure 32A:
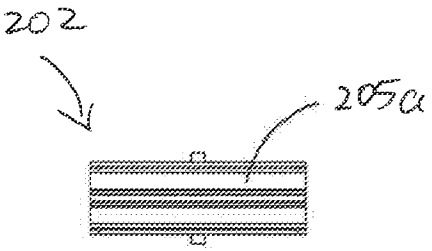
FIGS. 32A-32D are plan, perspective, front, and side views of an alternate first ceiling mount of FIG. 27 in isolation.
Figure 32B:
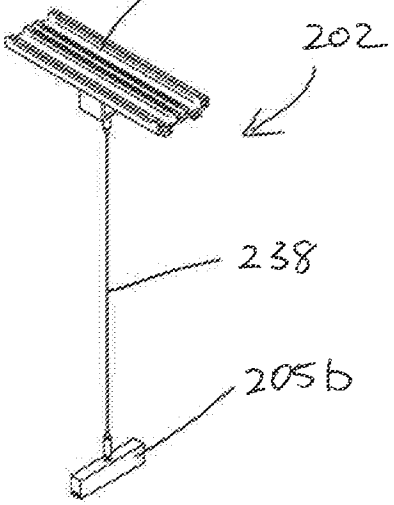
Figure 32C:
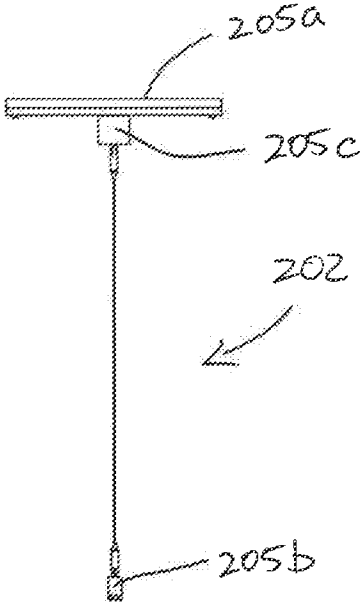
Figure 32D:
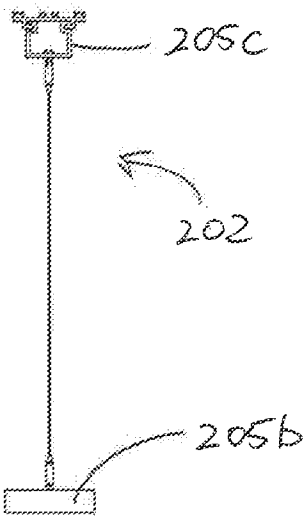
Figure 33:
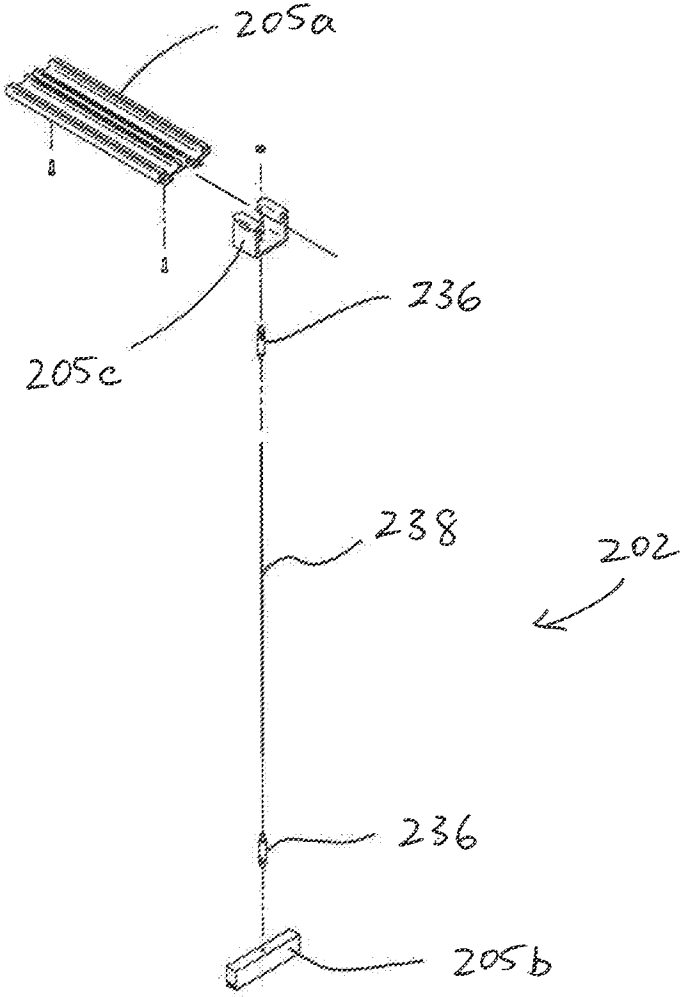
FIG. 33 is an exploded view of the first alternate ceiling mount of FIG. 32B.
Figure 34B:
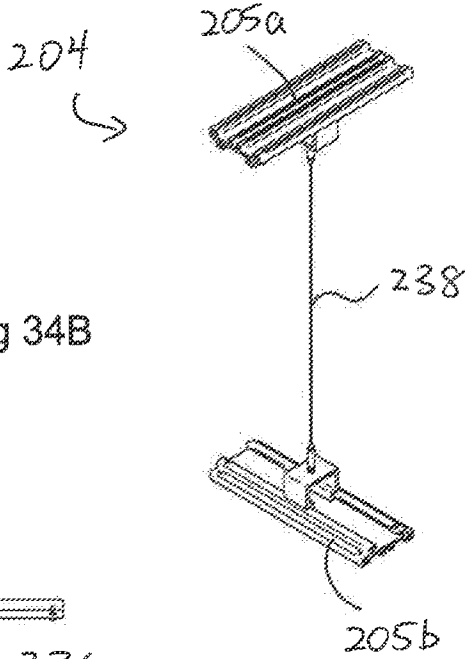
FIGS. 34A-34D are plan, perspective, front, and side views of an second alternate ceiling mount of FIG. 27 in isolation.
Figure 34D:
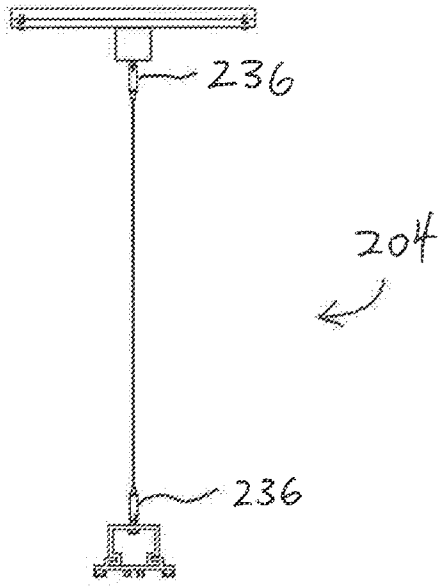
Figure 34A:
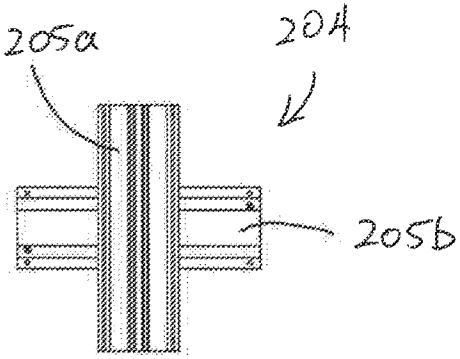
Figure 34C:
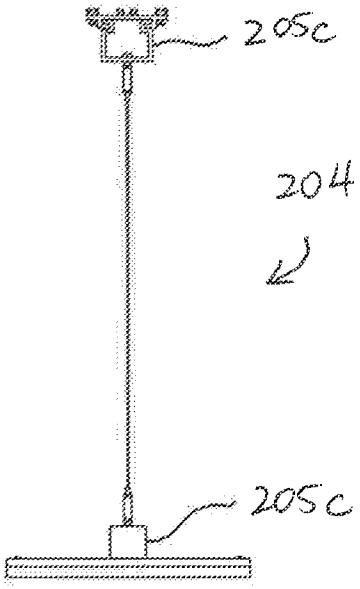
Figure 35:
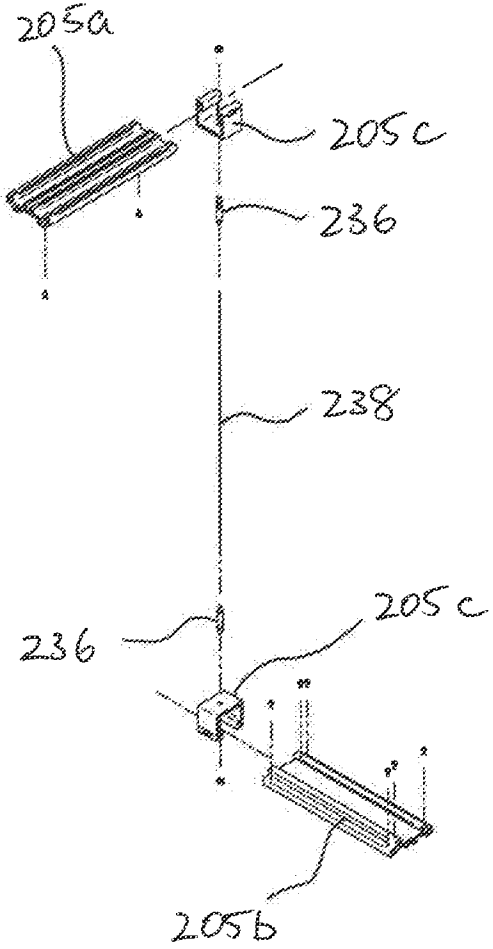
FIG. 35 is an exploded perspective view of the second alternate ceiling mount of FIG. 34B.
Figure 36B:
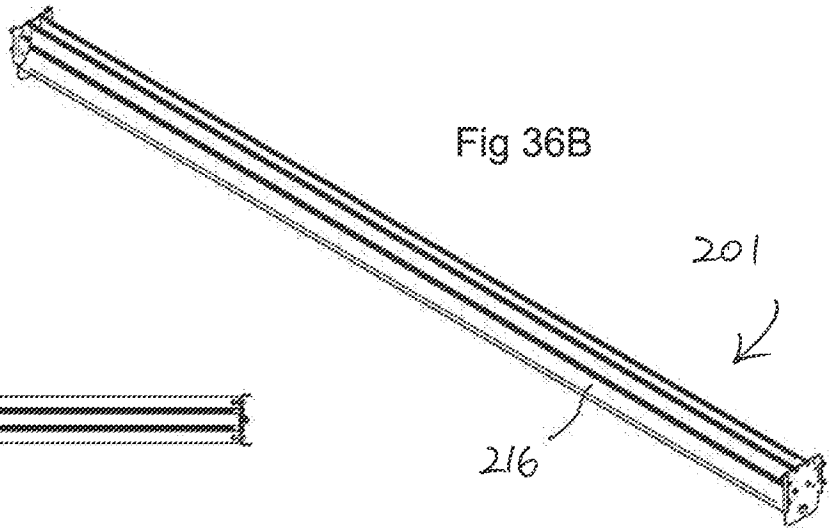
FIGS. 36A-36D are plan, perspective, front, and side views of an alternate rail of FIG. 26, in isolation.
Figure 36D:
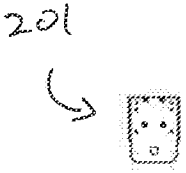
Figure 36A:
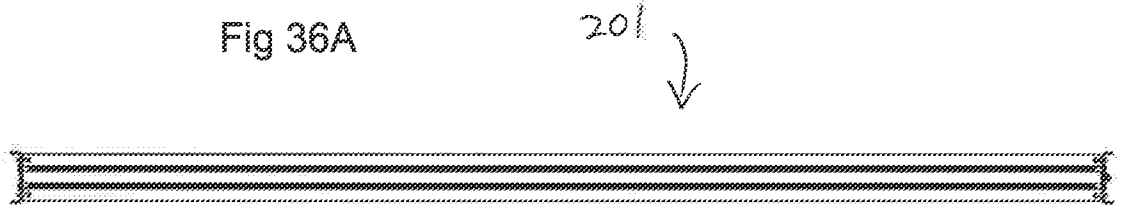
Figure 36C:
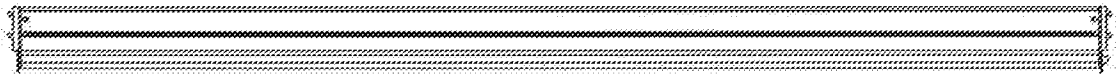
Figure 37:
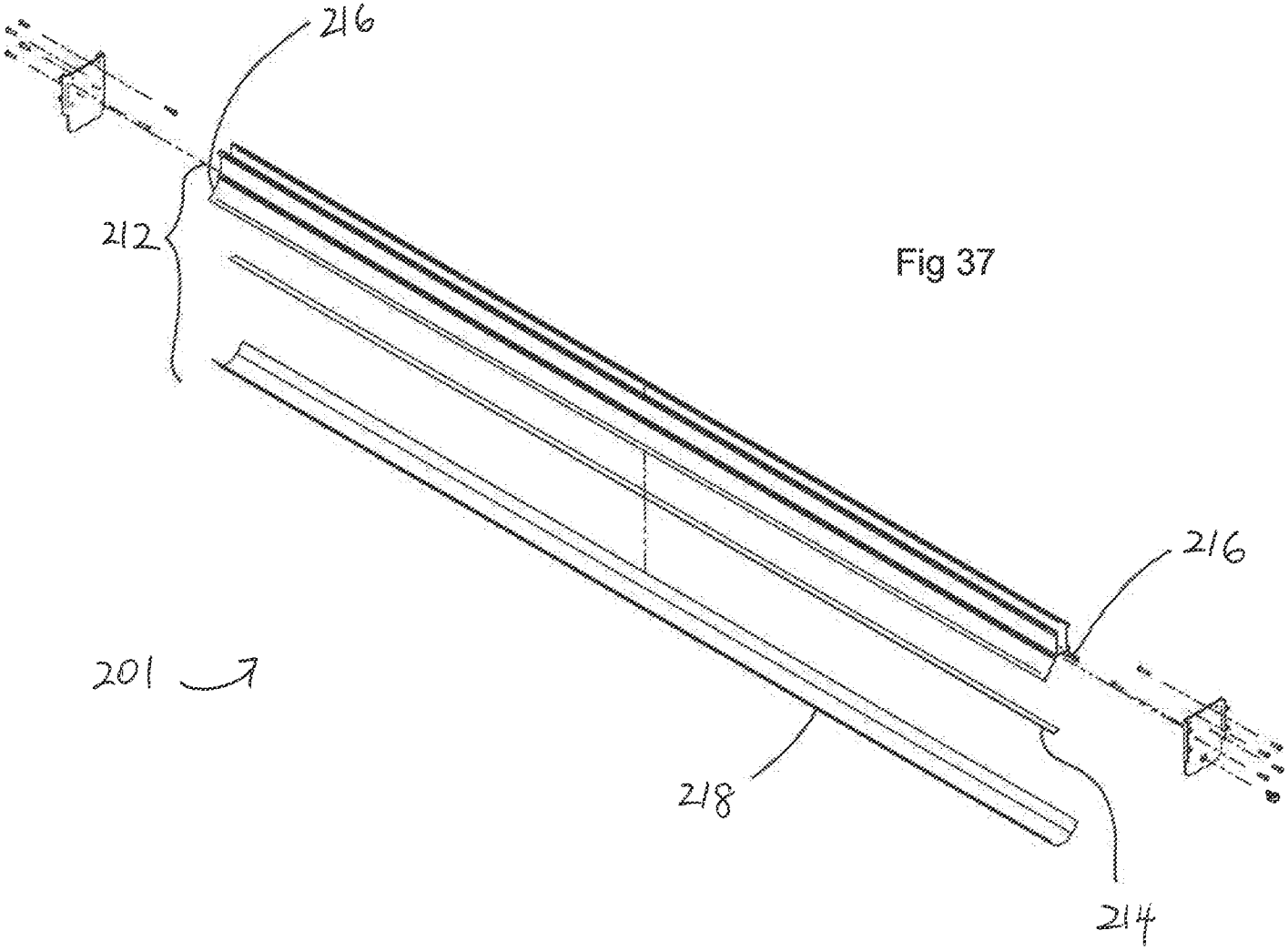
FIG. 37 is an exploded perspective view of the alternate rail of FIG. 36B.
Figure 38A:
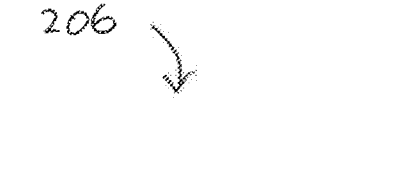
FIGS. 38A-38D are plan, perspective, front, and side views of an alternate hanger of FIG. 27, in isolation.
Figure 38B:
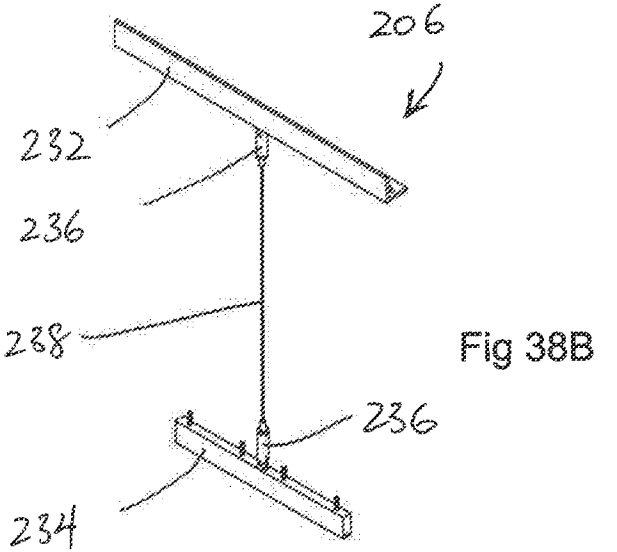
Figure 38C:
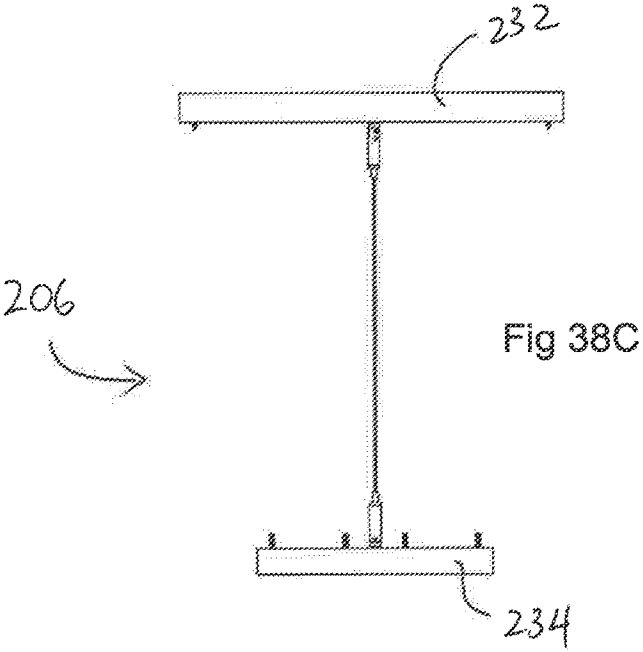
Figure 38D:
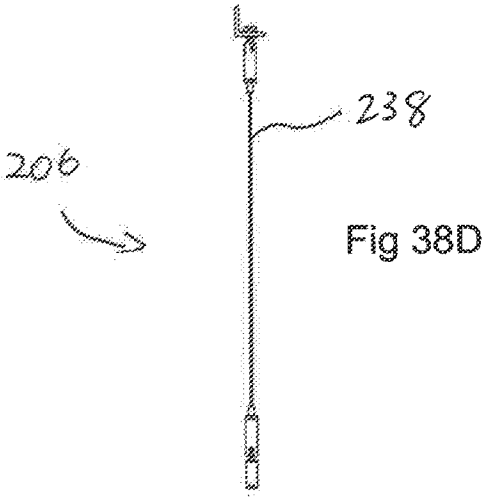
Figure 39:
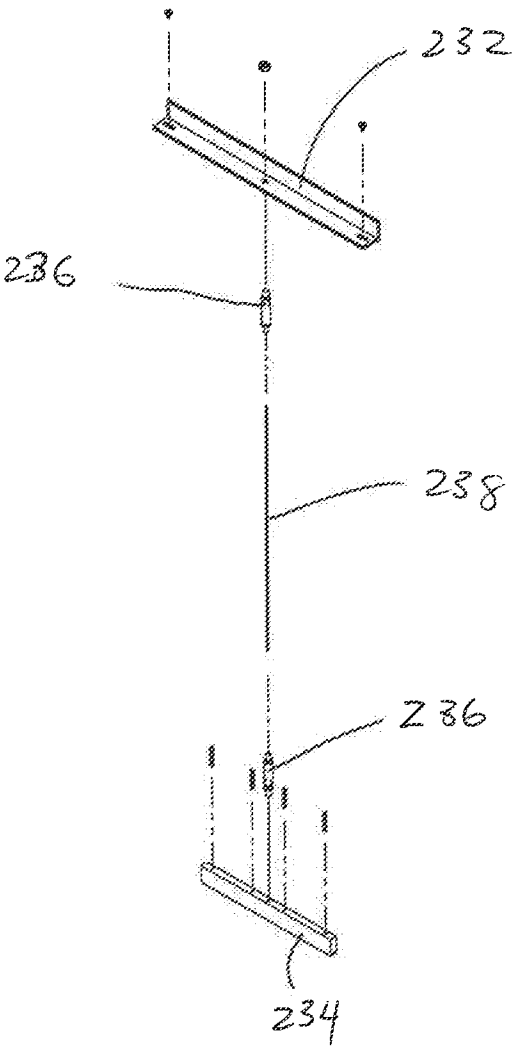
FIG. 39 is an exploded view of the alternate hanger of FIG. 38B.

Each light assembly 212 includes a pair of projections 216, extending along, and at an angle to, either side of corresponding rail 201 with their edges directed generally towards mesh panels 108. As best seen in FIG. 31B, projections 216 form an inverted V-shape flanking each side of LED light strip 214. In this manner, projections 216 direct light emitted from LED light strip 214. In this particular embodiment, projections 216 extend approximately 45 degrees from vertical. Each pair of projections 216 thus generally form a right angle.

Each light assembly 212 further includes a transparent or translucent lens 218 suspended by projections 216 below LED light strip 214. Similar to projections 216, each lens 218 also extends generally parallel to its corresponding rail 201. Lens 218 is configured to diffuse light emitted from the LED lights. To that end, lens 218 may be formed from a transparent or translucent material, as is known in the art.

In this particular embodiment, grid 104 is suspended from a ceiling or structure by an alternate embodiment of the ceiling mounts, designated as first ceiling mounts 202 and second ceiling mounts 204, which are, respectively, coupled to solid cross members 201*b* and hollow cross members 201*a*. Ceiling mounts 202, 204 are configured to secure and suspend grid 104 from the ceiling or structure. As shown in FIGS. 32A-35, first ceiling mounts 202 and second ceiling mounts 204 may be largely similar to one another. They may include an upper plate 205*a* for securing to the ceiling structure, a lower plate 205*b* for securing to grid 104, a U-bracket 205*c* secured to each plate for housing and securing a cable gripper, a cable gripper 236 secured to each U-bracket 205*c*, and a cable 238 secured therebetween. Cable grippers 236 may be configured to adjust the length of cable 238 for levelling purposes.

As noted above, hollow cross members 201*a* may allow wiring or other components to be fed therethrough. As will be understood by the skilled person, solid cross members 201*b* may be used interchangeably with hollow cross members 201*a* at the edges of, or internally within, grid 104.

Figure 27:
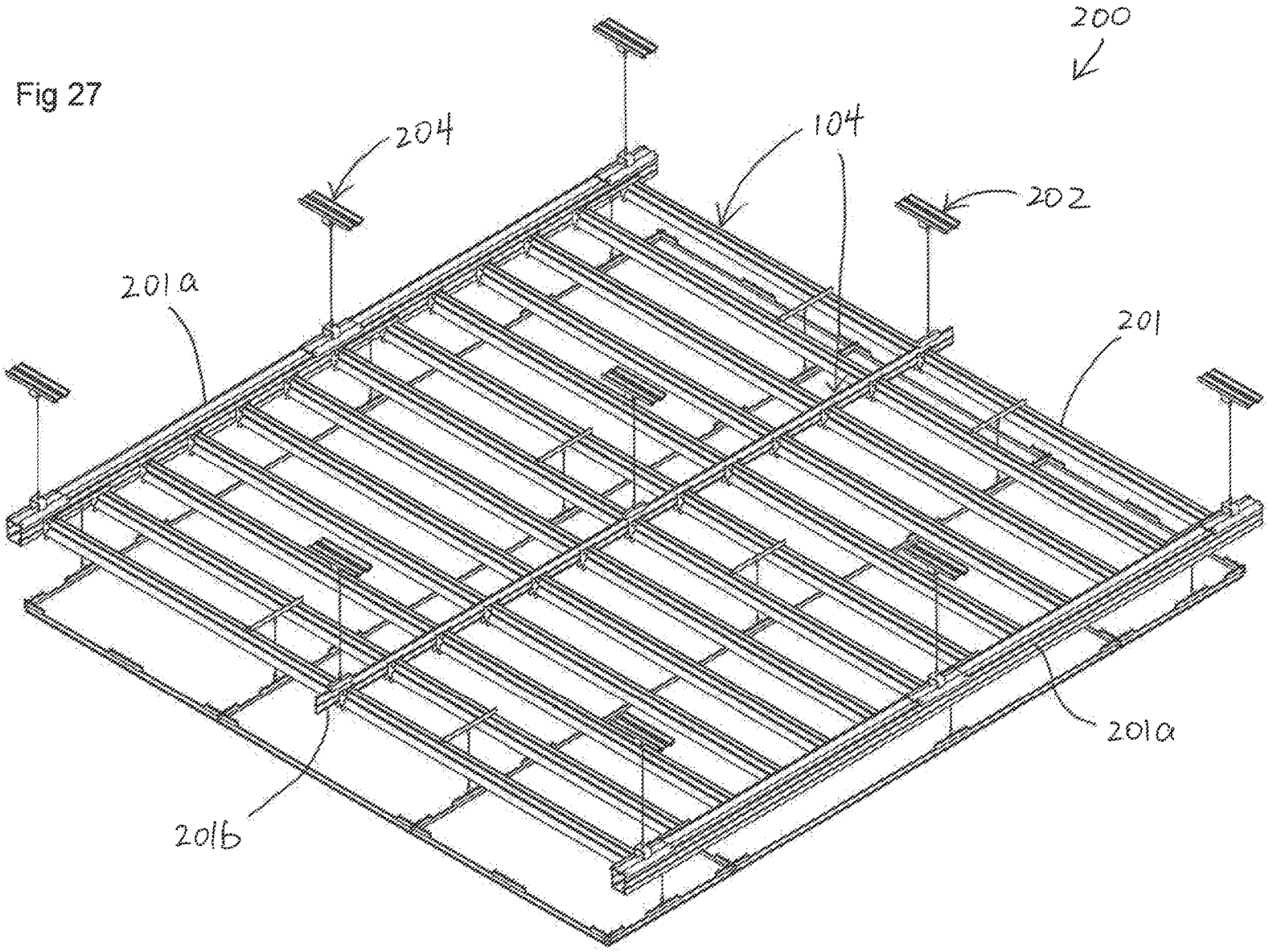
FIG. 27 is an upper perspective view of the ceiling system of FIG. 26.
Figure 30:
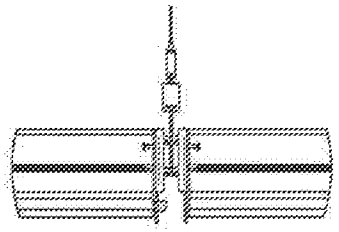
FIG. 30 is an enlarged view of portion "G" of FIG. 28.
Figure 29:
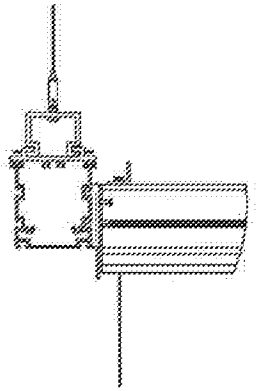
FIG. 29 is an enlarged view of portion "F" of FIG. 28.
Figure 28:
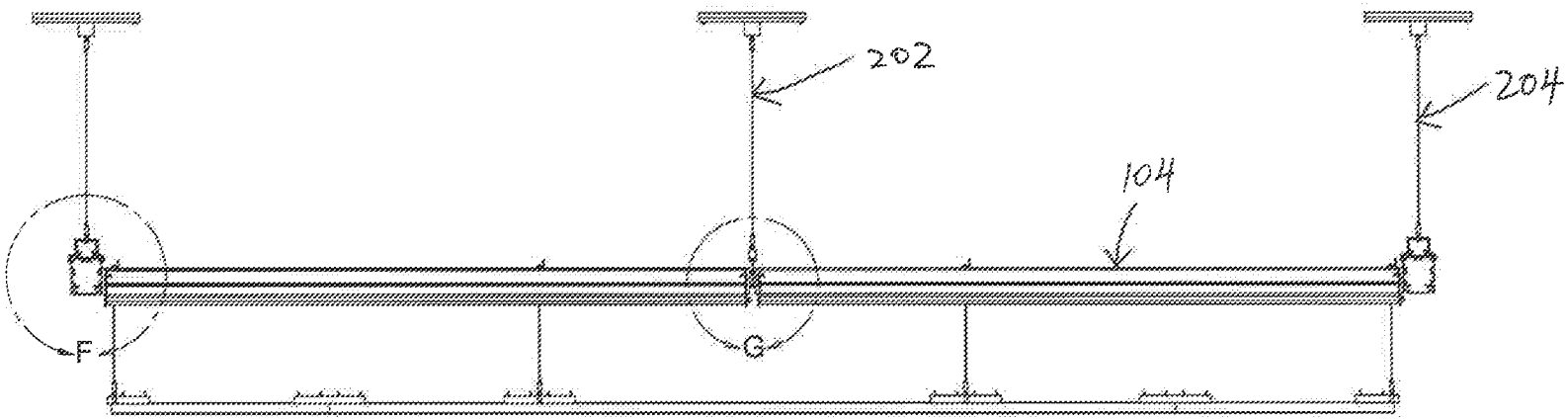
FIG. 28 is a front view of the ceiling system of FIG. 26.

An alternate embodiment of the hangers are shown in FIG. 27 and are represented by reference numeral 206. Hangers 206 engage grid 104 and are suspended therefrom. Hangers 206 (see FIGS. 38A-39) are, in turn, configured to be secured to modified T-bars. In this embodiment, hangers 206 include a top member 232, which is securable to rails 201; a bottom member 234, which is securable to a trim grid 210 (described further below); another cable gripper 236 secured to each of the top and bottom members 232, 234; and another cable 238 secured between the cable grippers. As before, cable grippers 236 of hangers 206 may be configured to adjust the length of cable 238 for leveling purposes.

Figure 40:
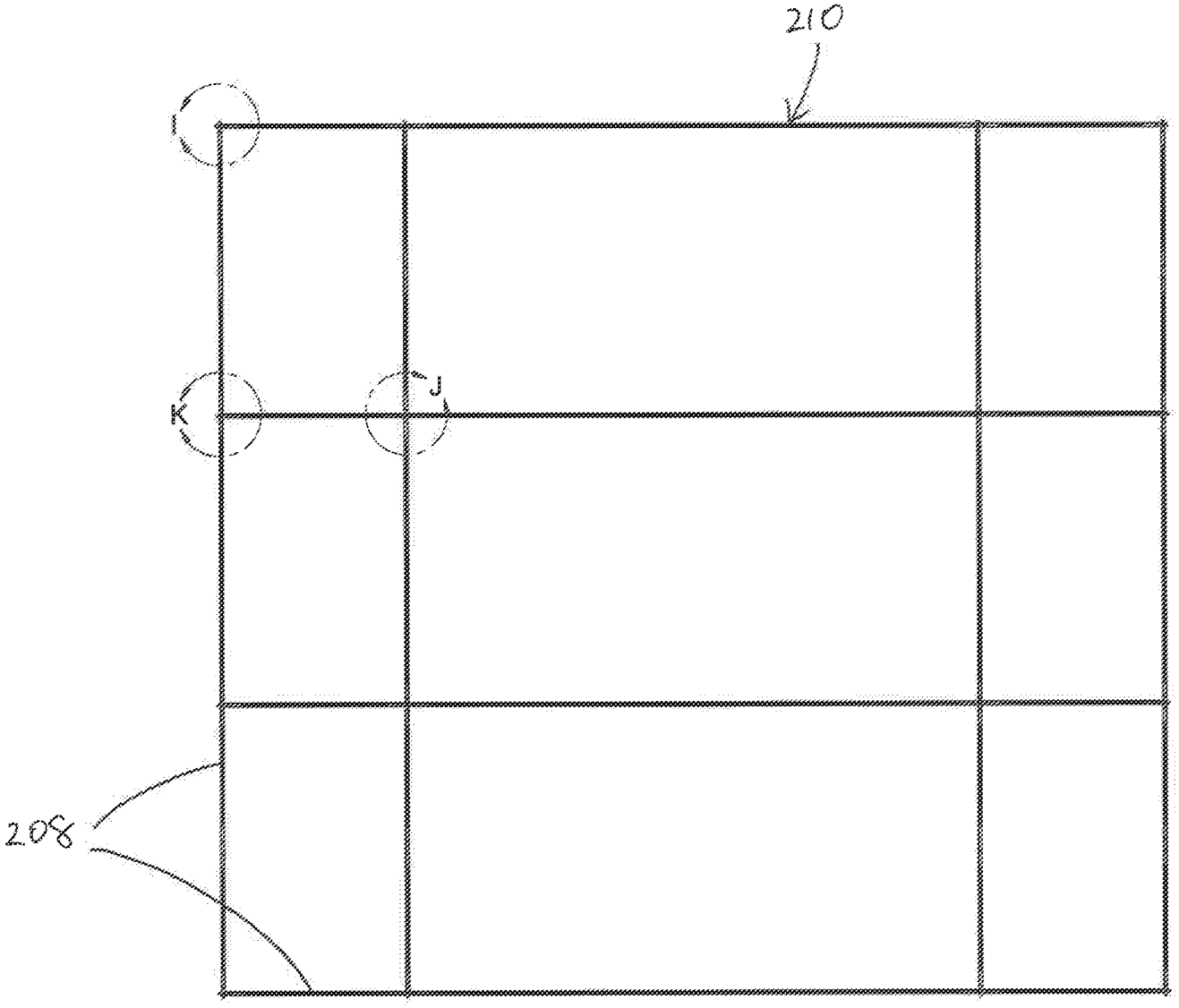
FIG. 40 is a plan view of a trim grid of FIG. 26, in isolation.
Figure 43:
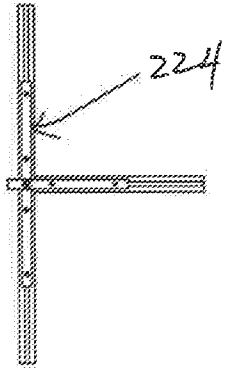
FIG. 43 is an enlarged view of portion "K" of FIG. 40.
Figure 42:
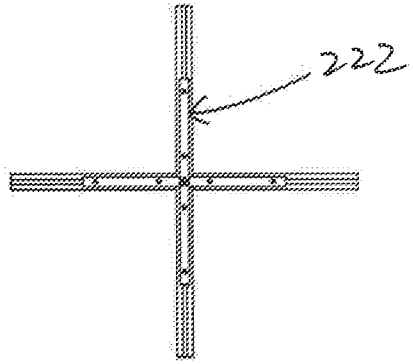
FIG. 42 is an enlarged view of portion "J" of FIG. 40.
Figure 41:
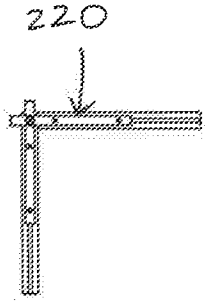
FIG. 41 is an enlarged view of portion "I" of FIG. 40.
Figure 44:
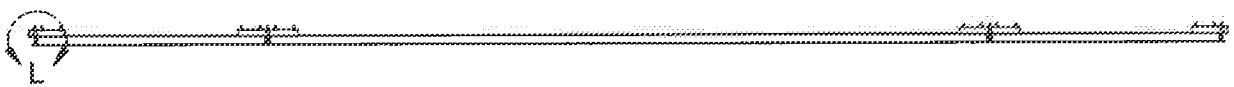
FIG. 44 is a side view of the trim grid of FIG. 40.
Figure 45:
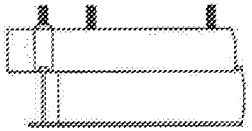
FIG. 45 is an enlarged view of portion "L" of FIG. 44.
Figure 46B:
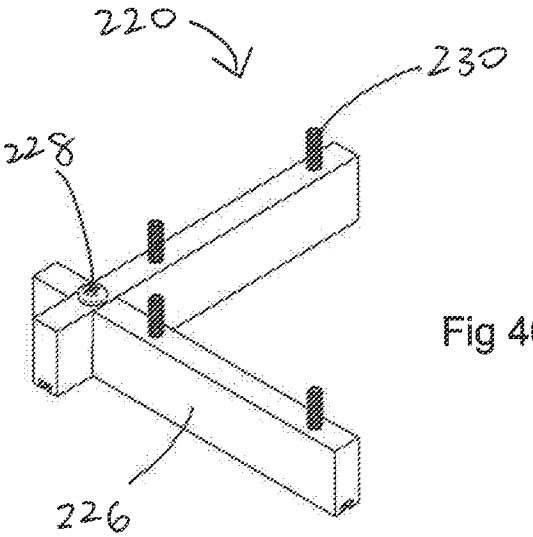
FIGS. 46A-46D are plan, perspective, front, and side views of an L-shaped trim bracket of FIG. 40 in isolation.
Figure 46D:
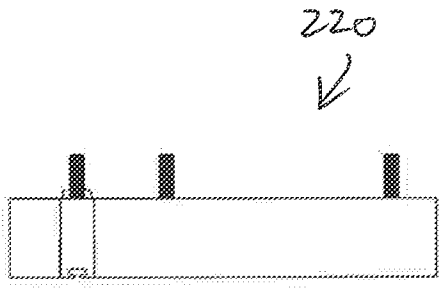
Figure 46A:
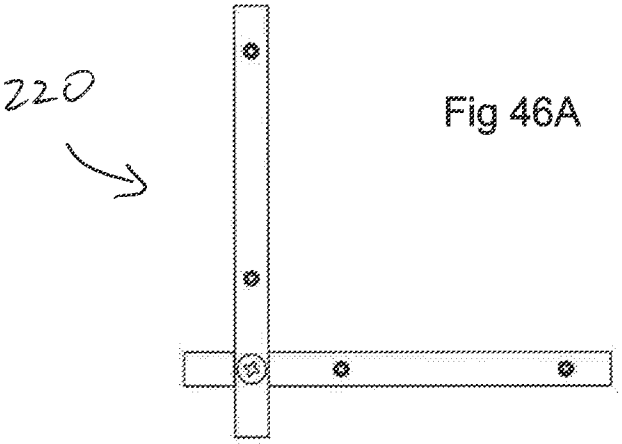
Figure 46C:
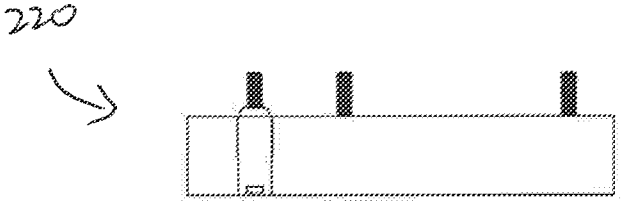
Figure 47:
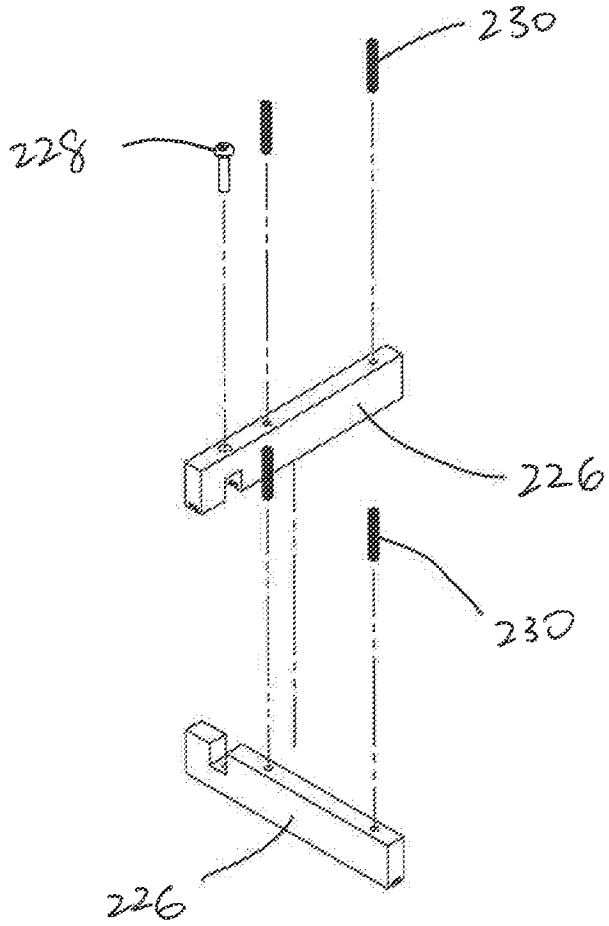
FIG. 47 is an exploded view of the L-shaped trim bracket of FIG. 46B.
Figure 48B:
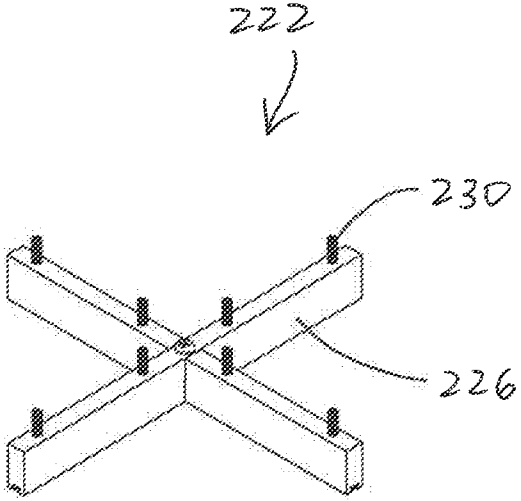
FIGS. 48A-48D are plan, perspective, front, and side views of the cross-shaped trim bracket of FIG. 42, in isolation.
Figure 48D:
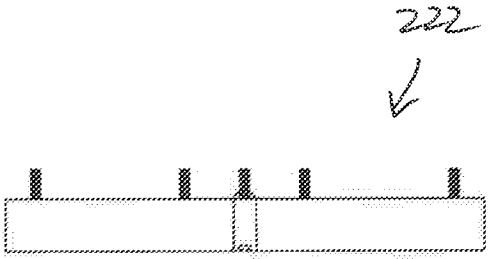
Figure 48A:
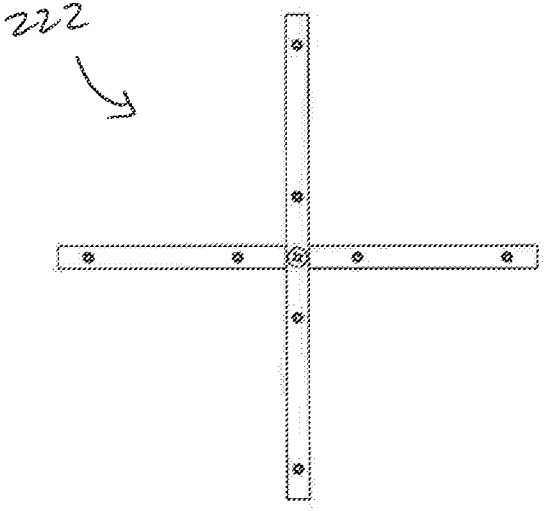
Figure 48C:
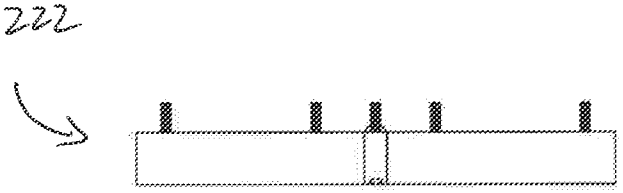
Figure 49:
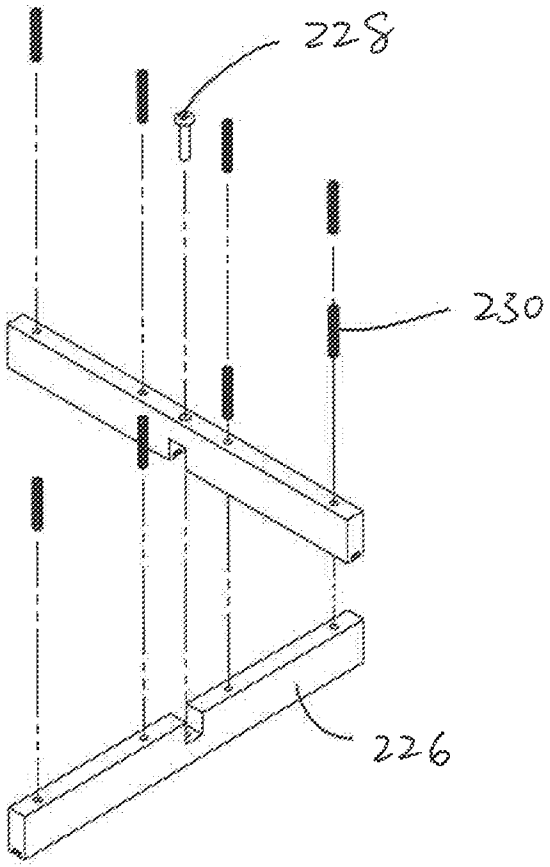
FIG. 49 is an exploded view of the trim bracket of FIG. 46B.
Figure 50B:
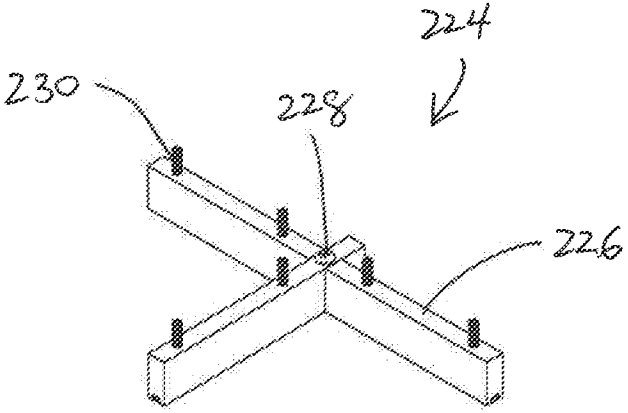
FIGS. 50A-50D are plan, perspective, front, and side views of the T-shaped trim bracket of FIG. 45, in isolation.
Figure 50D:
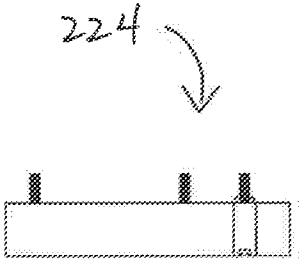
Figure 50A:
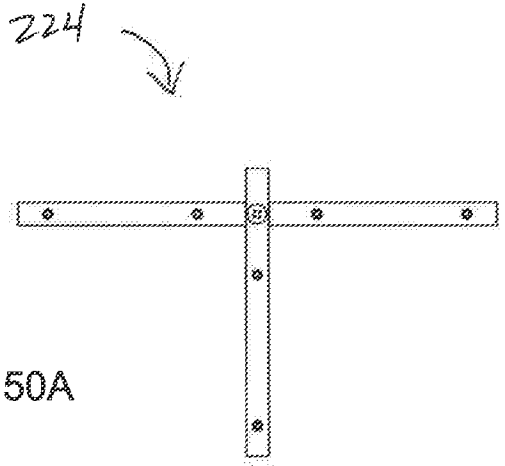
Figure 50C:
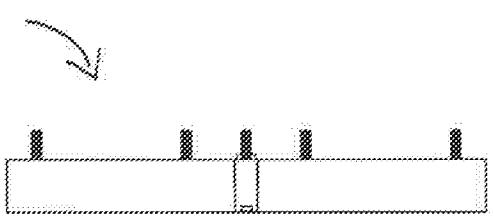
Figure 51:
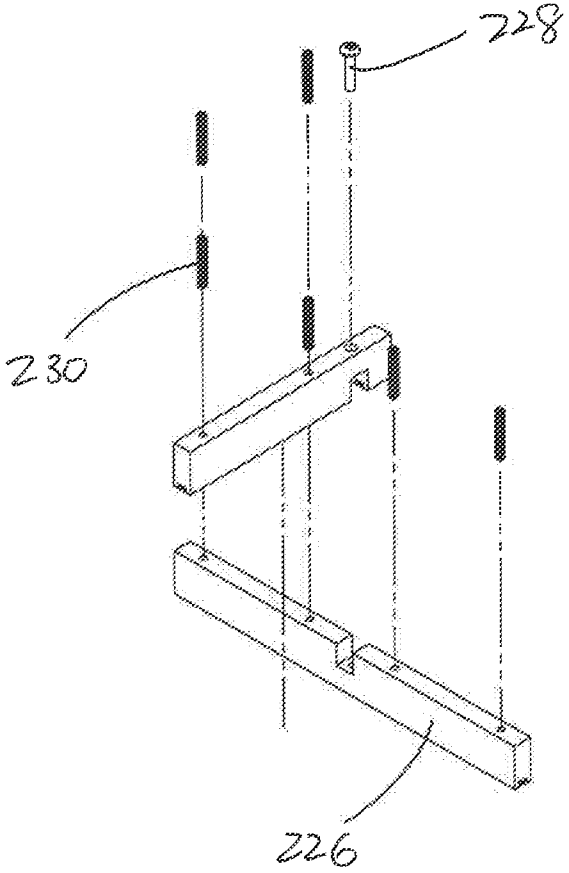
FIG. 51 is an exploded view of the trim bracket of FIG. 50B.

As shown in FIG. 40, trim grid 210 is formed from modified T-bars 208, whereby mending plates or brackets may secure the intersecting modified T-bars 208 together. FIGS. 41-43 show example embodiments of L-shaped, cross-shaped, and T-shaped mending plates or brackets, noted respectively by reference numerals 220, 222, and 224. Plates or brackets in the embodiment shown include intersecting rods 226 secured together with a fastener, such as a screw 228. Rods 226 are then securable to modified T-bars 208 via additional fasteners, such as set screws 230. When trim grid 210 is secured to bottom members 234 of hangers 206 (for example with set screws), and top members 232 of hangers 206 are secured to grid 104, trim grid 210 is suspended from grid 104 by hangers 206.

Figure 26:
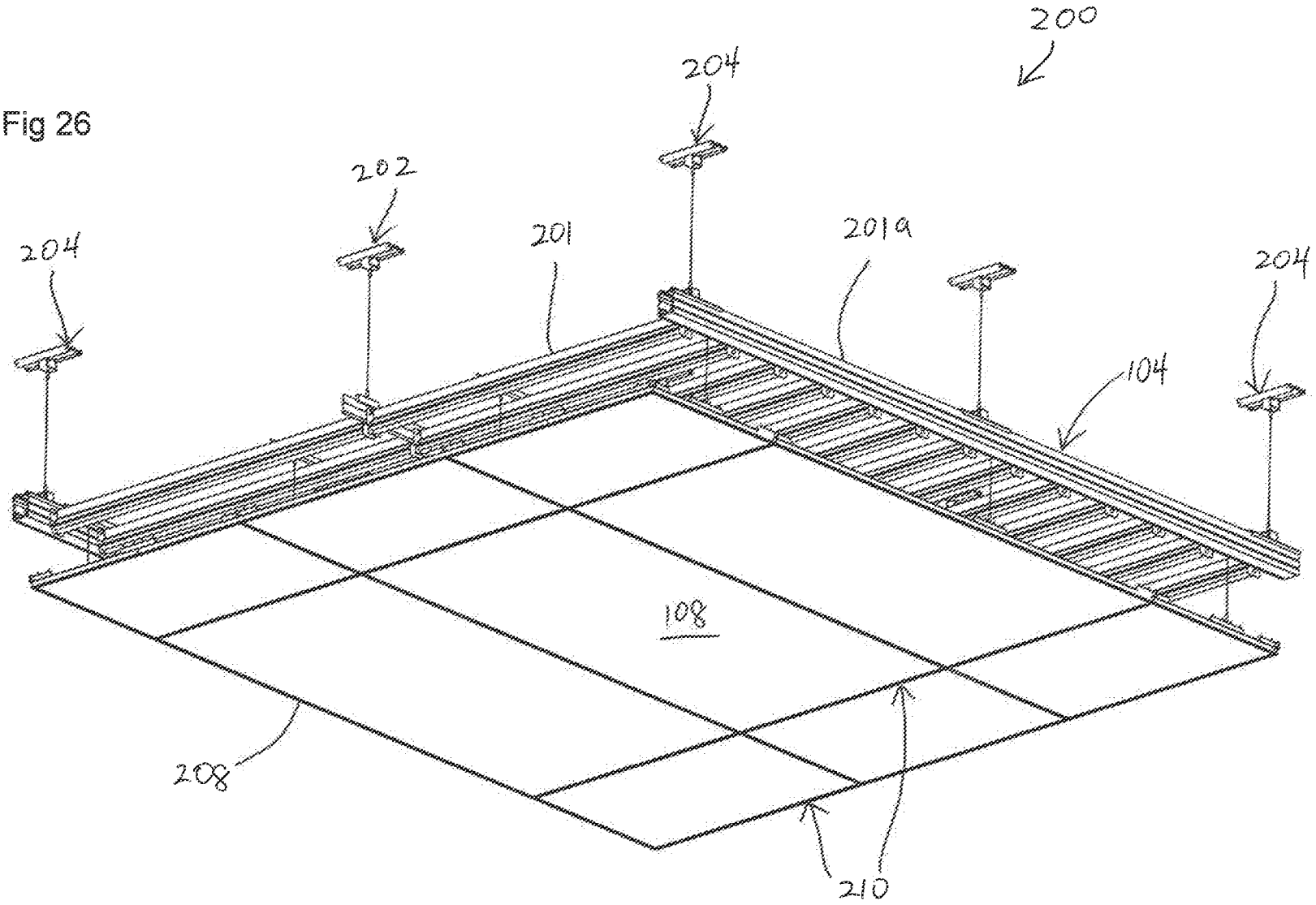
FIG. 26 is a bottom perspective view of a ceiling system according to another embodiment of the present disclosure.

Modified T-bars 208 in trim grid 210, in turn, are configured to support panels 108, which may be suspended and spaced apart from grid 104 on a common plane, see FIG. 26.

Ceiling system 200 may be arranged such that the distance between adjacent rails 201 and the distance between rails 201 and panels 108 is at a ratio of 1:1. In other words, the distance between adjacent rails 201 and the distance between rails 201 and panels 108 may be generally the same. For example, in certain embodiments, when the openings in panels 108 are about 5/16 inches by 5/16 inches, the distance between adjacent rails 201 and the distance between rails 201 and panels 108 may be about 12 inches.

As in the case of ceiling system 100, multiple tiles or panels 108 in ceiling system 200 may extend the length and width of the room. Of course, ceiling system 200 may be used to cover only part of a roof or ceiling in the room.

When panels 108 are translucent, transparent, or have defined openings therethrough, light from light assembly 212 may travel as shown in FIG. 31B. Each mesh panel may alternatively have a plurality of apertures for diffusing light from light assemblies 212

When the mesh panels are formed from translucent material, light hitting the mesh walls will tend to diffuse to create a brighter effect or a "glowing" ceiling. When light rays strike the panels directly below each LED light (see arrows in FIG. 31B), the light tends to pass directly through the panel, since only small amounts of light strike the filaments of mesh directly below the source of illumination. With less light hitting the mesh walls, this may give the appearance of an isolated, dark or poorly lit area right below each source of light. This is opposite to standard diffuser illumination.

In order to provide a more even distributed light through panels 108, projections 216 are designed to allow a portion of the light to intersect the panel at angles of up to approximately 45 degrees. Further, adjacent light assemblies 212 are specifically spaced apart, and the light assemblies 212 and panels 108 are also specifically spaced apart (eg in a ratio of approximately 1:1) so as to allow adjacent light sources to overlap and illuminate the mesh below each light source, thereby "filling" in the dark spots that might otherwise occur below the light sources. In this manner, ceiling system 200 may provide a "glowing" effect from panels 108 and a more even distribution of light below the panels.

Further, given the relatively slim profile of modified T-bars 208, the obstruction of light travelling therethrough tends to be minimized, allowing panels 108 to appear as a pane of light. It will be appreciated that, in certain applications, emergency or exit lighting or signage may be secured to panels 108 or grid 104. Where signage is hung from panels 108, the signage may be translucent and may itself be illuminated by light travelling through panel 108. Further, while hangers 10 and hangers 206 have been shown to be secured to grid 104, which in turn is secured to the roof structure of the room, hangers 10 and hangers 206 may alternatively be secured directly to the ceiling or roof of a room.

One potential advantage of the present disclosure is that since all the systems and/or fixtures may be secured to rails 102 (or rails 201) and/or cross members 102*a* (or cross members 201*a*/201*b*), and situated above tiles or panels 108, in use, the systems and/or fixtures would not typically be seen from, or be hanging, below the ceiling line formed by the panels. This contributes to the overall seamlessness of ceiling 110, through which light, sound, air and water may still pass.

It will be appreciated by those skilled in the art that other variations of the embodiments described herein may also be practiced without departing from the scope of the invention. Other modifications are possible, as are the production of a very wide variety of products for other applications.

The invention claimed is:

1. A ceiling system comprising:

a plurality of rails and cross members arranged in a grid, one or more of the plurality of rails having a light assembly secured thereto, each light assembly having a plurality of light emitting diodes (LEDs) positioned longitudinally along a corresponding rail of the plurality of rails;

a plurality of hangers secured to and suspended from the grid; and one or more mesh panels suspended by the plurality of hangers and spaced apart from a plurality of rib members, each of the mesh panels having a plurality of apertures for diffusing light from the one or more light assemblies;

wherein each light assembly has a pair of projections extending along, and at an angle to, either side of its corresponding rail, the projections having lower edges directed towards the mesh panels with each pair of projections forming an inverted V-shape, the projections flanking the LEDs so as to restrict light emitted from the LEDs and to focus and direct the light towards the mesh panels.

2. The ceiling system of claim 1, wherein each projection extends at an angle of approximately 45 degrees from its corresponding rail.

3. The ceiling system of claim 2, wherein each light assembly comprises a transparent or translucent lens suspended by the projections below the LED lights, the lens configured to diffuse light emitted from the LED lights.

4. The ceiling system of claim 3, arranged such that the distance between adjacent rails and the distance between the rails and the mesh panels is at a ratio of approximately 1:1.

5. The ceiling system of claim 4, wherein the distance between adjacent rails and the distance between the rails and the one or more mesh panels is about 12 inches.

* * * * *